US006951198B1

(12) United States Patent
Megli et al.

(10) Patent No.: US 6,951,198 B1
(45) Date of Patent: Oct. 4, 2005

(54) INCREASED ENGINE BRAKING WITH ADJUSTABLE INTAKE VALVE TIMING

(75) Inventors: Thomas Megli, Dearbom, MI (US); Alex Gibson, Ann Arbor, MI (US); John O. Michelini, Sterling Heights, MI (US); Nate Trask, Dearbom, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/888,664

(22) Filed: Jul. 8, 2004

(51) Int. Cl.[7] ..... F02D 13/04
(52) U.S. Cl. ..... 123/321; 123/322; 123/90.11
(58) Field of Search ..... 123/321

(56) References Cited

U.S. PATENT DOCUMENTS 6,155,217 A * 12/2000 Shiraishi et al. ..... 123/90.15
6,170,474 B1 * 1/2001 Israel ..... 123/568.14
6,192,857 B1 2/2001 Shimada
6,267,098 B1 * 7/2001 Vanderpoel ..... 123/321
6,371,065 B1 * 4/2002 Shiraishi et al. ..... 123/90.15
6,526,745 B1 * 3/2003 Ogiso ..... 60/285
6,601,563 B2 * 8/2003 Funke et al. ..... 123/321
2003/0019469 A1 * 1/2003 Mickiewicz et al. ..... 123/321

OTHER PUBLICATIONS

Gibson, A. O., Kolmanovski, I. V., 2003, "Modeling Positive Intake Valve Overlap Air Charge Response in Camless Engines," ACC Proceedings.

Ashhab, M.-S.S., Stefanopoulou, A.G., Cook, J.A., Levin, M.B., Control-Oriented Model for Camless Intake Process (Part I), ASME Journal of Dynamic Systems, Mesurement and Control, vol. 122, pp. 122-130, Mar. 2000.

* cited by examiner

*Primary Examiner*—John T. Kwon
(74) *Attorney, Agent, or Firm*—Allan J. Lippa; Alleman Hall McCoy Russell & Tuttle LLP

(57) ABSTRACT

A system and method for operating at least an intake and exhaust valve in a cylinder with a piston of an engine in a vehicle are described. In one aspect, the method comprises maintaining at least the exhaust valve in a closed position during a period of net engine torque less than zero. Further, during said period of net engine torque less than zero, operating with at least the intake valve open, then closing the intake valve, and then opening the intake valve.

24 Claims, 21 Drawing Sheets

Mechanical Exhaust Cam, EM Intake

INCREASED ENGINE BRAKING WITH ADJUSTABLE INTAKE VALVE TIMING

FIELD

The present description relates generally to systems for controlling engine braking during deceleration in an internal combustion engine of a passenger vehicle traveling on the road, and more particularly to controlling opening and/or closing timing of electromechanical intake and/or exhaust valves in the engine.

BACKGROUND AND SUMMARY

Internal combustion engines generally produce engine output torque by performing combustion in the engine cylinders. Specifically, each cylinder of the engine inducts air and fuel and combusts the air-fuel mixture, thereby increasing pressure in the cylinder to generate torque to rotate the engine crankshaft via the pistons. One method to improve engine fuel economy during deceleration is to deactivate fuel injection to all or a selected group of cylinders to thereby reduce combustion torque and increase engine braking.

The above approach can provide engine braking from engine friction and pumping work (due to manifold vacuum). The compression and expansion of air in the cylinders during the compression and expansion stroke results in energy storage and recovery, and thus may not contribute to engine braking. As such, one approach to increase engine braking is referred to as a "Jake Brake". A Jake Brake opens the exhaust valve at top dead center of compression, thereby reducing or eliminating the energy recovery of the expansion stroke. This, in turn, can increase engine braking significantly since the unrestrained expansion is dissipating energy stored during the compression stroke.

One approach to incorporate Jake Brake type engine braking is described in U.S. Pat. No. 6,192,857, in which exhaust valve timing is adjusted to control a level of engine braking provided. See also FIG. 20 herein. However, in the approach of '857, the early opening of the exhaust valve may produce flow through the exhaust system of oxygen rich gas during fuel-cut operation. This can degrade catalyst performance due to cooling and saturation, while also increasing emitted noise due to unrestrained expansion of gasses into the exhaust system.

An approach to reduce airflow during fuel-cut operation is described in U.S. Pat. No. 6,526,745, in which at least one (or both) of the intake or exhaust valve is placed in a closed state to block any flow through the engine. However, while this may reduce airflow through the exhaust, engine braking effects may be lost (or significantly reduced). In other words, if there is no air flowing through the engine, engine braking due to pumping work is reduced or lost. Further, since there is no indication of any expansion or compression work being performed, engine braking may be significantly reduced.

The inventors herein have recognized the above issues. And, faced with the paradoxical approach of the prior art (where either engine braking may be obtained at the expense of catalyst performance, or catalyst performance may be maintained at the expense of engine braking), the inventors herein have developed various systems and approaches that attempt to reduce at least some of the above tradeoffs.

In one example, a method for operating a cylinder with at least an intake and exhaust valve, the engine in a vehicle, may be used. The method comprises maintaining at least the exhaust valve in a closed position during a period of net engine torque less than zero, and during said period of net engine torque less than zero, operating with at least the intake valve open, then closing the intake valve, and then opening the intake valve.

In this way, it may be possible to provide engine braking while reducing net flow through the engine. In other words, since the exhaust valve is maintained closed, flow is impeded from the intake to the exhaust, or vice versa. And, the intake valve may be operated to provide expansion or compression braking in the cylinder, for example, in which flow may enter and exit the cylinder through the intake valve. In this way, desired engine braking can be obtained even when there is reduced braking from engine reduced engine pumping work.

In one specific example where a throttle is used, by adjusting intake valve timing to generate braking (expansion or compression type), reduced noise may be achieved due to closing (fully or partially) the throttle plate. Also, by adjusting intake valve timing to generate braking, it may be possible to enable use of a mechanical exhaust valve system, if desired.

Note that the opening of the intake valve can be either full or partial opening. Also note that the period can be an expressly defined period, or a variable period, for example. Further, conditions of net engine torque less than zero may be conditions where torque of the engine is actively controlled to be negative, or conditions that result in such a situation, among other conditions, for example.

DETAILED DESCRIPTION

Implementation of fuel-cut operation on engines, such as deceleration fuel shut-off (DFSO), may be challenging due issues such as:

(1) catalyst breakthrough and cooling issues due to lean air flow through the exhaust;

(2) catalyst performance issues due to the lean exhaust gas flow that may lead to over-storage of oxygen in the exhaust, which may reduce NOx conversion; and (3) limited control of the amount of engine braking provided, which may lead to torque disturbances and reduced drive feel.

In other words, net flow through the engine may transport heat from the catalyst into the surrounding environment, which may degrade catalyst efficiency. Additionally, the engine braking characteristic may be altered if fuel-cut operation is used.

Electromechanical valve actuation (EVA) may be used with fuel-cut operation to improve performance. In other words, EVA valves on one side of the engine (intake/exhaust) may be deactivated in the closed position, which may prevent or reduce the breakthrough of air and unwanted oxygen storage. Further, the engine braking torque level can be controlled by opening and closing the valves on the other side of the engine at an appropriate time during the engine cycle to provide expansion or compression work. This may effectively provide a dashpot to smooth the transitions, while at the same time reduce catalyst cooling and oxygen saturation.

Note that as described in more detail below, several different schemes may be employed. In one example, the intake valve(s) may be deactivated and then the exhaust valve(s) can be opened and closed to obtain the desired average braking torque. In another example, the exhaust valve(s) can be closed and the intake valve(s) can be opened and closed. Further combinations of these approaches can be used, as well as operating some cylinders in an engine braking mode, and others combusting air or in a deactivated stated without compression or expansion braking. Also note that in different operating modes, different types of engine braking can be used. For example, in conditions which require increased braking levels, compression braking (or combined compression and expansion braking) can be used, whereas during conditions which require less engine braking, expansion braking can be used.

In some cases, the following advantages may be achieved:

(1) reduced lurching by achieving smooth engine braking torque modulation;

(2) reduced air flow through the catalyst; and/or (3) greater available level of engine braking torque, which may enable coordinated braking strategies to increase wheel-brake life.

Figure 1:
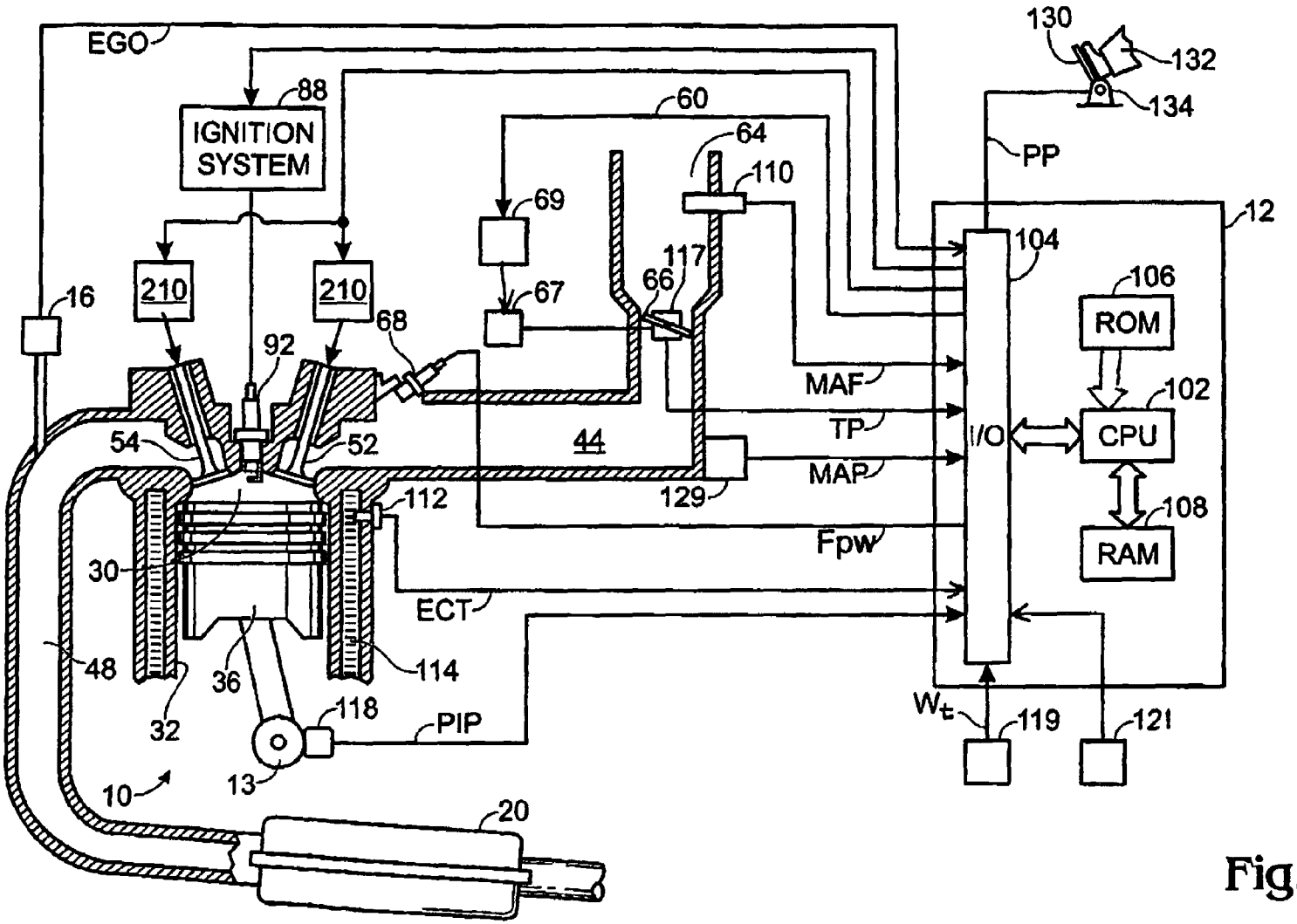
FIG. 1 is a block diagram of an engine illustrating various components.

Referring now to FIG. 1, an example internal combustion engine 10 is shown. Engine 10 is an engine of a passenger vehicle or truck driven on roads by drivers. Engine 10 can coupled to torque converter via crankshaft 13. The torque converter can also coupled to transmission via a turbine shaft. The torque converter has a bypass clutch, which can be engaged, disengaged, or partially engaged. When the clutch is either disengaged or partially engaged, the torque converter is said to be in an unlocked state. The turbine shaft is also known as transmission input shaft. The transmission comprises an electronically controlled transmission with a plurality of selectable discrete gear ratios. The transmission also comprises various other gears such as, for example, a final drive ratio. The transmission can also be coupled to tires via an axle. The tires interface the vehicle to the road.

Internal combustion engine 10 may comprise a plurality of cylinders, one cylinder of which, shown in FIG. 1, is controlled by electronic engine controller 12. Engine 10 includes combustion chamber 30 and cylinder walls 32 with piston 36 positioned therein and connected to crankshaft 13. Combustion chamber 30 communicates with intake manifold 44 and exhaust manifold 48 via respective intake valve 52 and exhaust valve 54. Intake manifold 44 may be a plastic intake manifold in one example, or an aluminum manifold in another example. Exhaust gas oxygen sensor 16 is coupled to exhaust manifold 48 of engine 10 upstream of catalytic converter 20. In one example, converter 20 is a three-way catalyst for converting emissions during operation about stoichiometry.

As described more fully below with regard to FIGS. 2A and 2B, at least one of, and potentially both, of valves 52 and 54 are controlled electronically via apparatus 210.

Intake manifold 44 communicates with throttle body 64 via throttle plate 66. Throttle plate 66 is controlled by electric motor 67, which receives a signal from ETC driver 69. ETC driver 69 receives control signal (DC) from controller 12. In an alternative embodiment, no throttle is utilized and airflow is controlled solely using valves 52 and 54. Further, when throttle 66 is included, it can be used to reduce airflow if valves 52 or 54 become degraded, or to create vacuum to draw in recycled exhaust gas (EGR), or fuel vapors from a fuel vapor storage system having a valve controlling the amount of fuel vapors.

Intake manifold 44 is also shown having fuel injector 68 coupled thereto for delivering fuel in proportion to the pulse width of signal (fpw) from controller 12. Fuel is delivered to fuel injector 68 by a conventional fuel system (not shown) including a fuel tank, fuel pump, and fuel rail (not shown).

Engine 10 further includes conventional distributorless ignition system 88 to provide ignition spark to combustion chamber 30 via spark plug 92 in response to controller 12. In the embodiment described herein, controller 12 is a conventional microcomputer including: microprocessor unit 102, input/output ports 104, electronic memory chip 106, which is an electronically programmable memory in this particular example, random access memory 108, and a conventional data bus.

Controller 12 receives various signals from sensors coupled to engine 10, in addition to those signals previously discussed, including: measurements of inducted mass air flow (MAF) from mass air flow sensor 110 coupled to throttle body 64; engine coolant temperature (ECT) from temperature sensor 112 coupled to cooling jacket 114; a measurement of manifold pressure from MAP sensor 129, a measurement of throttle position (TP) from throttle position sensor 117 coupled to throttle plate 66; a measurement of transmission shaft torque, or engine shaft torque from torque sensor 121, a measurement of turbine speed (Wt) from turbine speed sensor 119, where turbine speed measures the speed of shaft 17, and a profile ignition pickup signal (PIP) from Hall effect sensor 118 coupled to crankshaft 13 indicating an engine speed (N). Alternatively, turbine speed may be determined from vehicle speed and gear ratio.

Continuing with FIG. 1, accelerator pedal 130 is shown communicating with the driver's foot 132. Accelerator pedal position (PP) is measured by pedal position sensor 134 and sent to controller 12.

In an alternative embodiment, where an electronically controlled throttle is not used, an air bypass valve (not shown) can be installed to allow a controlled amount of air to bypass throttle plate 62. In this alternative embodiment, the air bypass valve (not shown) receives a control signal (not shown) from controller 12.

Also, in yet another alternative embodiment, intake valve 52 can be controlled via actuator 210, and exhaust valve 54 actuated by an overhead cam, or a pushrod activated cam. Further, the exhaust cam can have a hydraulic actuator to vary cam timing, known as variable cam timing.

In still another alternative embodiment, only some of the intake valves are electrically actuated, and other intake valves (and exhaust valves) are cam actuated.

Further, various types of valve control actuators can be used, in addition to the electromechanical approach listed above. For example, any type of valve control mechanism can be used, such as, for example, hydraulic variable cam timing actuators, cam switching actuators, electro-hydraulic actuators, or combinations thereof.

Note also that the above approach is not limited to a dual coil actuator, but rather it can be used with other types of actuators. For example, the actuators of FIG. 4 or 6 can be single coil actuators. In any case, the approach synergistically utilizes the high number of actuators (engine valves, in this example) to aid in reducing the number of power devices and the size of the wiring harness. Thus, the dual coil actuator increases this synergy, but a single coil actuator would have similar potential.

Figure 2B:
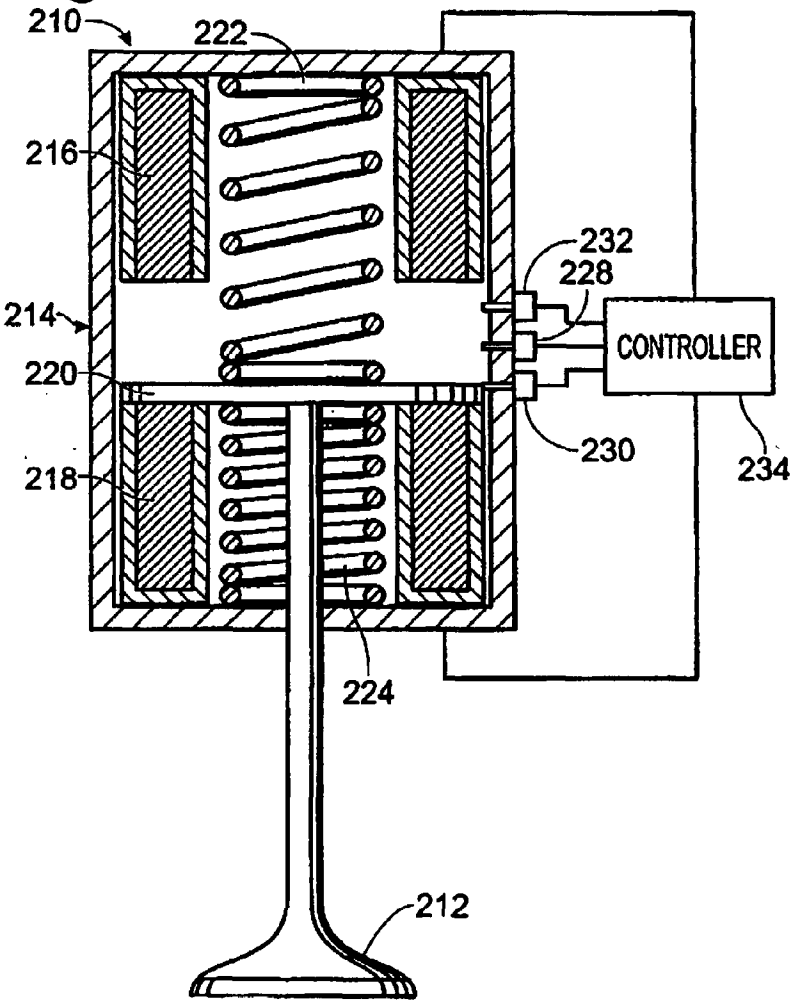
FIG. 2B shows a schematic vertical cross-sectional view of an apparatus for controlling valve actuation as shown in FIG. 1, with the valve in the fully open position.
Figure 2A:
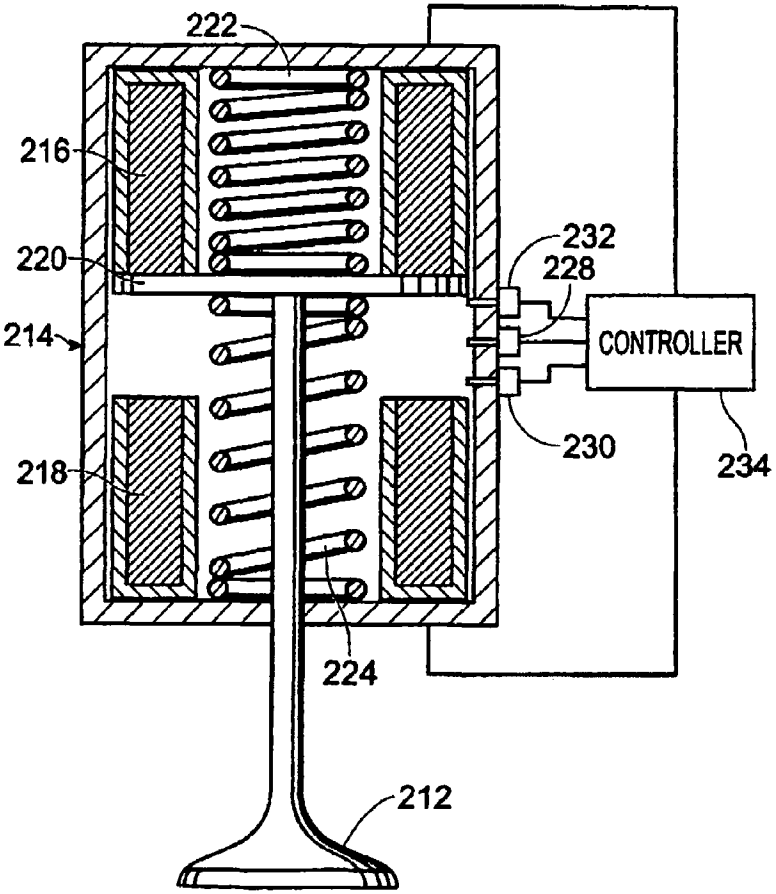
FIG. 2A show a schematic vertical cross-sectional view of an apparatus for controlling valve actuation, with the valve in the fully closed position.

Referring to FIGS. 2A and 2B, an apparatus 210 is shown for controlling movement of a valve 212 in engine 10 between a fully closed position (shown in FIG. 2A), and a fully open position (shown in FIG. 2B). The apparatus 210 includes an electromagnetic valve actuator (EVA) 214 with upper and lower coils 216, 218 which electromagnetically drive an armature 220 against the force of upper and lower springs 222, 224 for controlling movement of the valve 212.

Switch-type position sensors 228, 230, and 232 are provided and installed so that they switch when the armature 220 crosses the sensor location. It is anticipated that switch-type position sensors can be easily manufactured based on optical technology (e.g., LEDs and photo elements) and when combined with appropriate asynchronous circuitry they would yield a signal with the rising edge when the armature crosses the sensor location. It is furthermore anticipated that these sensors would result in cost reduction as compared to continuous position sensors, and would be reliable.

Controller 234 (which can be combined into controller 12, or act as a separate controller) is operatively connected to the position sensors 228, 230, and 232, and to the upper and lower coils 216, 218 in order to control actuation and landing of the valve 212.

The first position sensor 228 is located around the middle position between the coils 216, 218, the second sensor 230 is located close to the lower coil 218, and the third sensor 232 is located close to the upper coil 216.

As described above, engine 10, in one example, has an electromechanical valve actuation (EVA) with the potential to maximize torque over a broad range of engine speeds and substantially improve fuel efficiency. The increased fuel efficiency benefits are achieved by eliminating the throttle, and its associated pumping losses, (or operating with the throttle substantially open) and by controlling the engine operating mode and/or displacement, through the direct control of the valve timing, duration, and or lift, on an event-by-event basis.

In one example, controller 234 includes any of the example power converters described below.

While the above method can be used to control valve position, an alternative approach can be used that includes position sensor feedback for potentially more accurate control of valve position. This can be use to improve overall position control, as well as valve landing, to possibly reduce noise and vibration.

Figure 3:
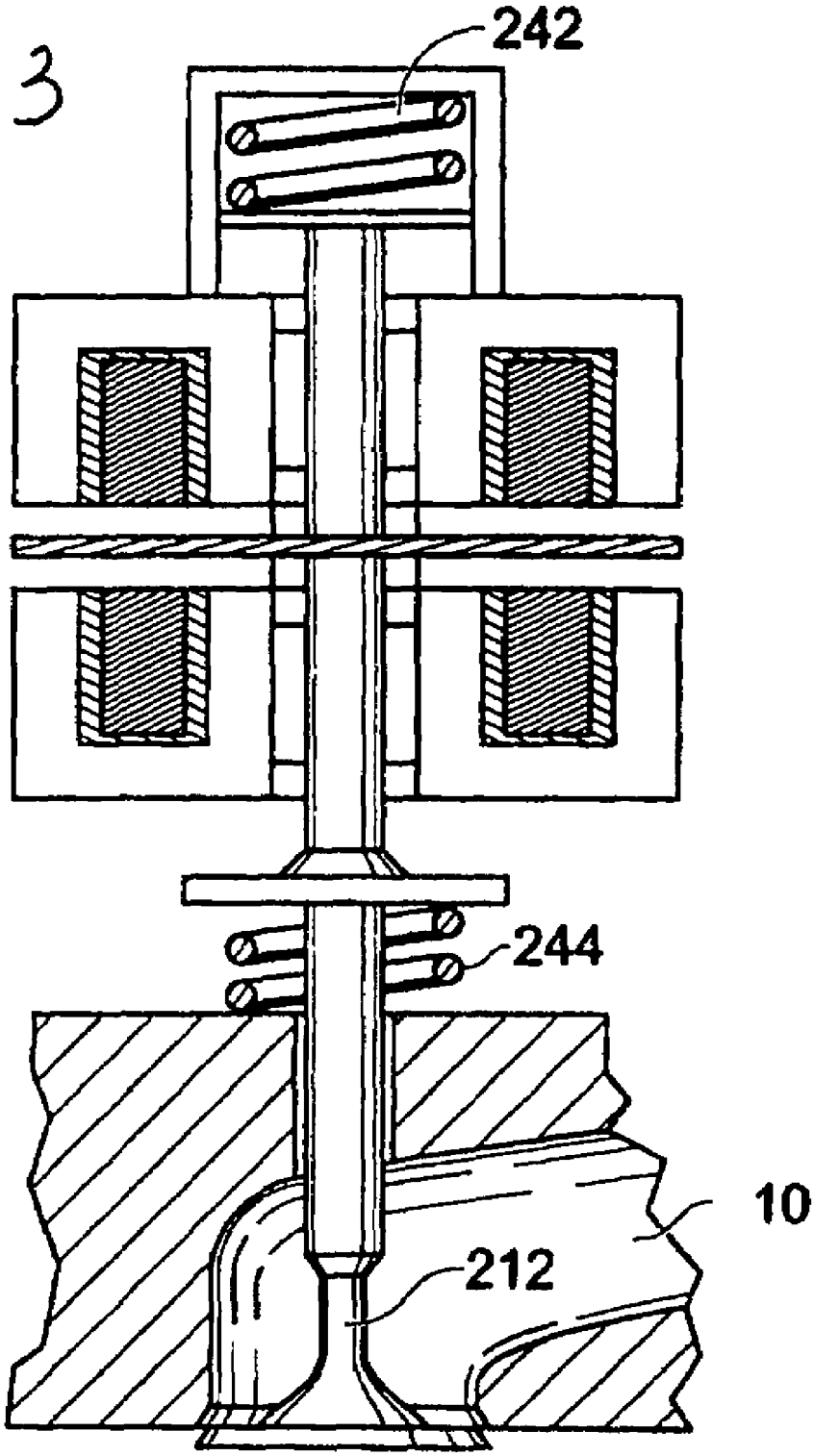
FIG. 3 shows an alternative electronic valve actuator configuration.

FIG. 5 shows an alternative embodiment dual coil oscillating mass actuator with an engine valve actuated by a pair of opposing electromagnets (solenoids), which are designed to overcome the force of a pair of opposing valve springs 242 and 244 located differently than the actuator of FIGS. 2A and 2B (other components are similar to those in FIGS. 2A and 2B, except that FIG. 3 shows port 310, which can be an intake or exhaust port). Applying a variable voltage to the electromagnet's coil induces current to flow, which controls the force produced by each electromagnet. Due to the design illustrated, each electromagnet that makes up an actuator can only produce force in one direction, independent of the polarity of the current in its coil. High performance control and efficient generation of the required variable voltage can therefore be achieved by using a switch-mode power electronic converter.

As illustrated above, the electromechanically actuated valves in the engine remain in the half open position when the actuators are de-energized. Therefore, prior to engine combustion operation, each valve goes through an initialization cycle. During the initialization period, the actuators are pulsed with current, in a prescribed manner, in order to establish the valves in the fully closed or fully open position. Following this initialization, the valves are sequentially actuated according to the desired valve timing (and firing order) by the pair of electromagnets, one for pulling the valve open (lower) and the other for pulling the valve closed (upper).

The magnetic properties of each electromagnet are such that only a single electromagnet (upper or lower) need be energized at any time. Since the upper electromagnets hold the valves closed for the majority of each engine cycle, they are operated for a much higher percentage of time than that of the lower electromagnets.

While FIGS. 2A, 2B, and 3 appear show the valves to be permanently attached to the actuators, in practice there can be a gap to accommodate lash and valve thermal expansion.

The following description describes various example processes and valve timings that may be used to generate and adjust engine braking torque.

Figure 4B:
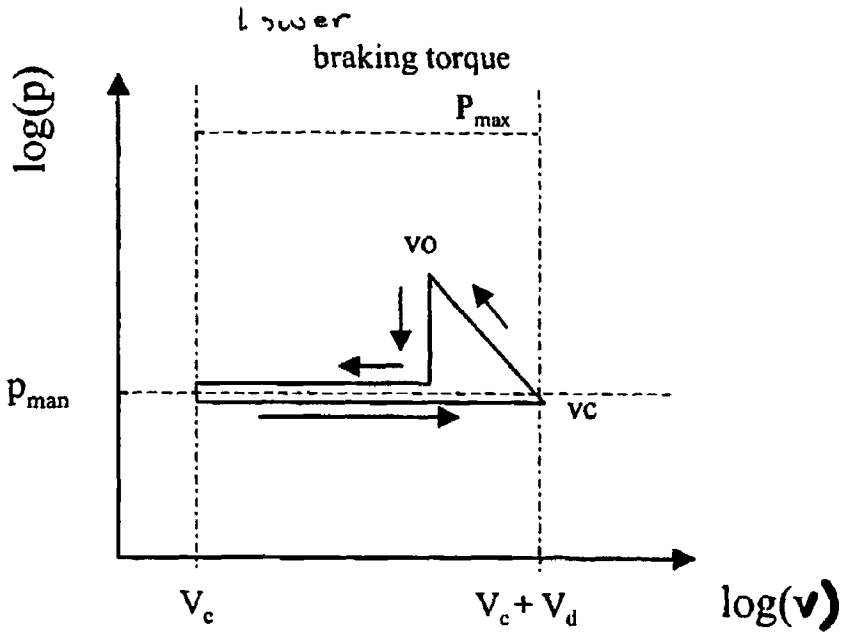
FIGS. 4A and 4B show engine braking increased via compression work where a valve is closed on the upstroke to generate a positive gage pressure in the cylinder, and is then opened to create an unrestrained expansion and negative gas work, where valve opening (vo) time may be varied to vary the engine braking level.
Figure 4A:
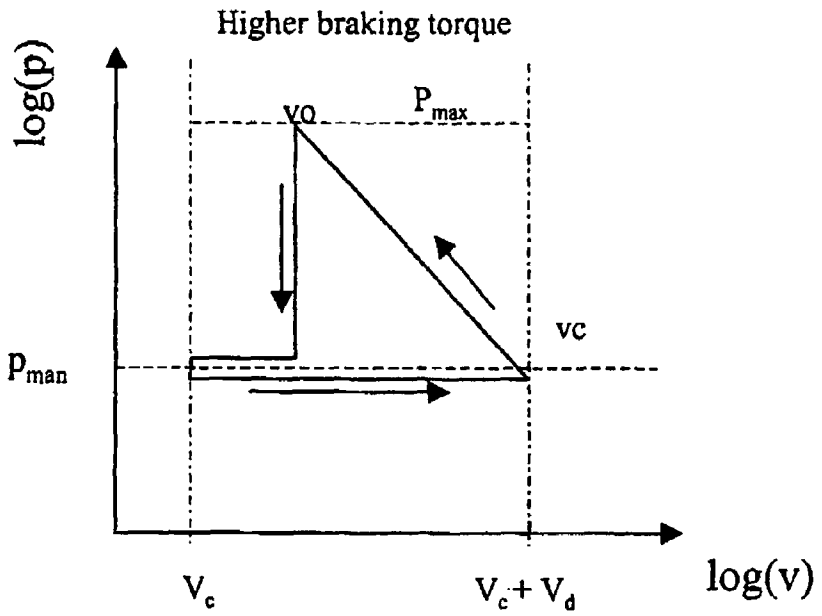

One example is described in FIGS. 4A and 4B. FIGS. 4A and 4B show engine braking increased via compression work where a valve (or valves) on one side of the engine is maintained closed and the valve (or valves) on the other side of the engine is operated as indicated. Specifically, the valve is closed on the upstroke to generate a positive gage pressure in the cylinder, and is then opened to create an unrestrained expansion and negative gas work. Further, the Figures show how valve opening (vo) time may be varied to vary the engine braking level. In the figure, Vc is the clearance volume of the cylinder, Vd is the displacement of the piston, and Pman in the manifold pressure.

Specifically, in FIG. 4A, the valve may be open during the downstroke of the piston to establish a minimum in-cylinder pressure which may be substantially equal to the exhaust (or intake) manifold pressure. The valve may then be closed near bottom dead center and may remain closed for a portion of the upstroke. The valve may then be opened after a desired level of pressure (which can correlate to a desired amount of engine braking torque) is reached and then an unrestrained expansion of the gas occurs. This creates negative work performed by the engine piston on the gas, which enters and exits on the same side (intake/exhaust) of the engine, thereby avoiding or reducing engine flow through the exhaust from that cylinder.

By varying the valve opening time, the level of negative work changes, which then establishes the engine braking torque characteristic. FIG. 4B illustrates a case where the valve is closed near BDC, the gas then expands to lower pressure levels until the valve is opened. The valve opening time then determines the amount of negative work and is used to set the engine braking torque level.

Note that in some cases, a limit may be imposed on compression pressure obtained for valve opening timing. For example, the latest practical valve opening (vo) time can occur when the pressure in the cylinder is about 10 bar. Pressures higher than a limit (if applicable) may make it more difficult to open the valve. A limit check may be placed on any desired valve opening timing that may occur higher than a threshold pressure, if desired.

Also note that while FIGS. 4A and 4B show varying valve opening timing to vary the engine braking torque created by compression work, valve closing timing may also be varied, or combinations there. Also, the cycles of FIGS. 4A and/or 4B can be applied to either intake or exhaust valves. Various of these alternative embodiments are described in more detail with regard to FIGS. 7A–7L, and more specifically with regard to FIGS. 7B, 7D, for example. Thus, it should be noted that many variants of valve timing are possible.

In the example of generating braking torque via compression braking, the valve(s) on one side of the engine may be maintained closed, and the valve(s) on the other side of the engine can be closed from an open position at a first piston position, and then opened at a second piston position closer to the top center piston position than the first position. Note that this can be done within a single upward piston stroke, or over one or more cycles (e.g., valve(s) on both sides of the engine are closed for one or more strokes in between the closing at the first position and opening at the second position).

As noted above, in the approach illustrated by the example of FIGS. 4A and 4B, gasses are pushed in and out of the cylinder through the same side (intake/exhaust) of the engine (since the valve(s) on the other side of the engine is maintained closed, at least during the period where work is done on the gasses in the cylinder), thereby avoiding or reducing engine flow through the exhaust from that cylinder.

When this is performed on the intake side (via actuation of one or more intake valves while exhaust valves are closed), noise may be reduced by closing a throttle plate in the intake manifold. Such operating may reduce the ability for noise to travel through the induction system and increase noise suppression. Further, in the case where this is performed on the exhaust side (via actuation of one or more exhaust valves while the intake valve(s) is maintained closed), noise may be reduced compared with a Jake brake since there is reduce net flow out of the engine. Further, by varying the opening/closing timing of the exhaust valve during this mode of operation, noise may also be reduced.

Figure 5B:
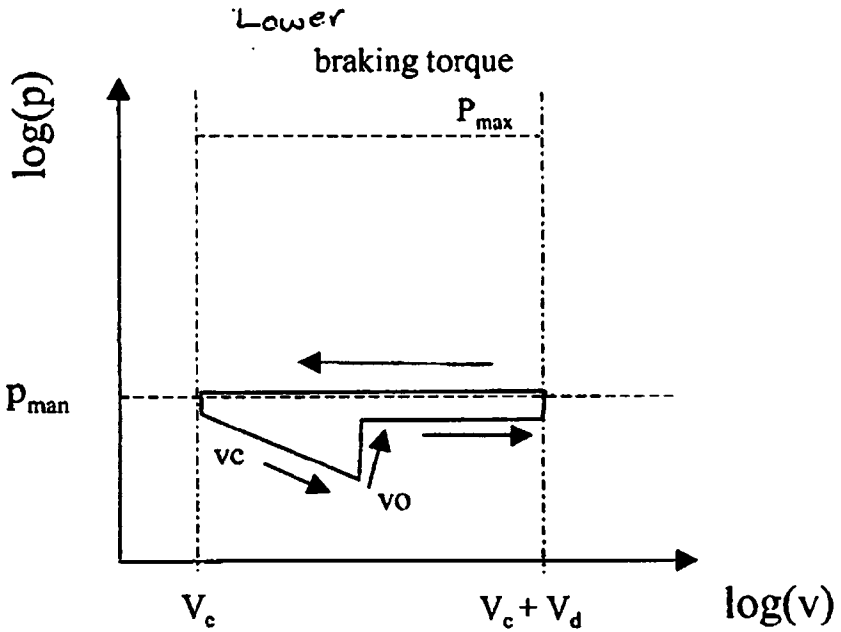
FIGS. 5A and 5B show engine braking increased via expansion work where a valve is closed near bottom dead center (BDC) to create negative gage pressure in the cylinder, and the valve is then opened to expand gases from the manifold into the cylinder, where valve opening timing may be varied to vary engine braking levels.
Figure 5A:
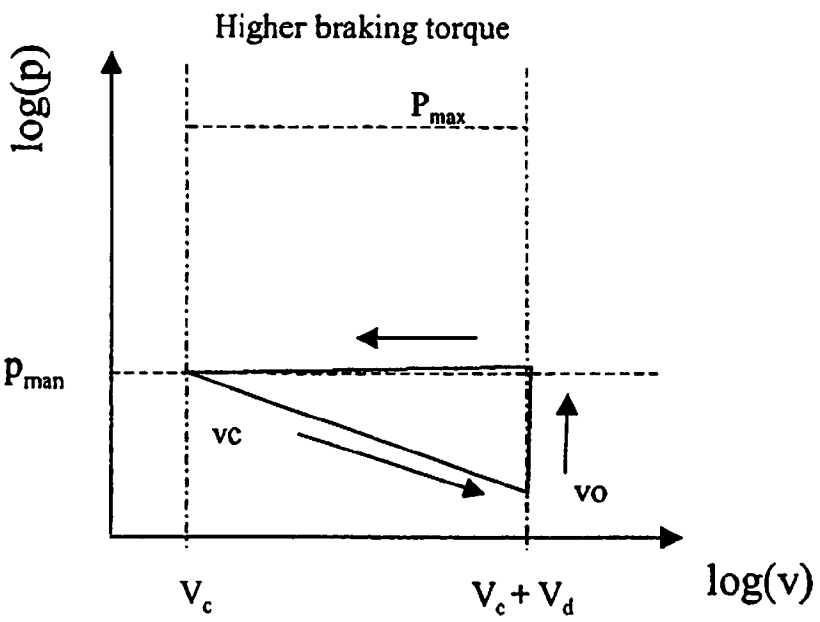

Another example is illustrated in FIGS. 5A and 5B. FIGS. 5A and 5B show engine braking increased via expansion work where a valve (or valves) on one side of the engine is maintained closed and a valve (or valves) on the other side of the engine is operated as indicated. For example, the operated valve may be closed near bottom dead center (BDC) to create negative gage pressure in the cylinder, and then opened to expand gases from the manifold into the cylinder. Further, valve opening timing (and/or closing timing) may be varied to vary engine braking levels as illustrated. Also, this can be performed on either side of the engine, just as in the case of engine braking due to compression work illustrated in FIGS. 4A and 4B. Various alternative embodiments are described in more detail with regard to FIGS. 7A–7L, 8A–B, and 10A-b, for example, and more specifically with regard to FIGS. 7A and 7C, for example.

In the example of generating braking torque via expansion braking, the valve(s) on one side of the engine may be maintained closed, and the valve(s) on the other side of the engine can be closed from an open position at a first piston position, and then opened at a second piston position closer to the bottom center position than the first position. Note that this can be done within a single downward piston stroke, or over one or more cycles (e.g., valve(s) on both sides of the engine are closed for one or more strokes in between the closing at the first position and opening at the second position).

One result obtained with expansion work is that different pressure differentials relative to atmospheric pressure can be obtained compared with compression braking, which can be explained from the relationship of the gasses defined for a polytropic process of an ideal gas ($pV^{\gamma}$= constant, where $\gamma$ is the specific heat ratio). In other words, expanding the clearance volume gasses (filled at atmospheric) with a given compression ratio of can yield a pressure differential less than compressing the maximum volume (clearance volume plus displacement filled at atmospheric pressure). As one example, the maximum pressure (Pmax) that can be achieved in the cylinder is roughly 21 bar (where atmospheric is roughly 1 bar) with a compression ratio of 10 and $\gamma$ of 1.33, which gives roughly a 20 bar pressure differential. Alternatively, the minimum pressure that can be obtained is a complete vacuum (0 bar), which gives a maximum pressure differential of roughly 1 bar for expansion braking. Freely expanding the compressed gas in compression braking may thus generate more noise in the engine than compared with expansion braking, especially in the case of a plastic intake manifold if intake side expansion/compression work is used. The above is one example theory that may explain operation, and is not relied upon herein.

Note that in the case of creating engine brake torque in the cylinder, gasses may also be moved into and out of the cylinder via the same side (intake/exhaust of the engine), and thus may reduce flow through the exhaust (at least from that cylinder). Further, in the case of expansion work, engine noise may be reduce (on either the intake or exhaust side) since gasses are not being forced out of the cylinder at high pressure, but rather are being forced into the cylinder. Noise may be further reduced on the intake side as well via a closed, or partially closed, throttle plate.

Note also that in the case of expansion work, there may not be a pressure limit on valve opening since the valve opening may actually be assisted by the vacuum created in the cylinder.

Figure 6B:
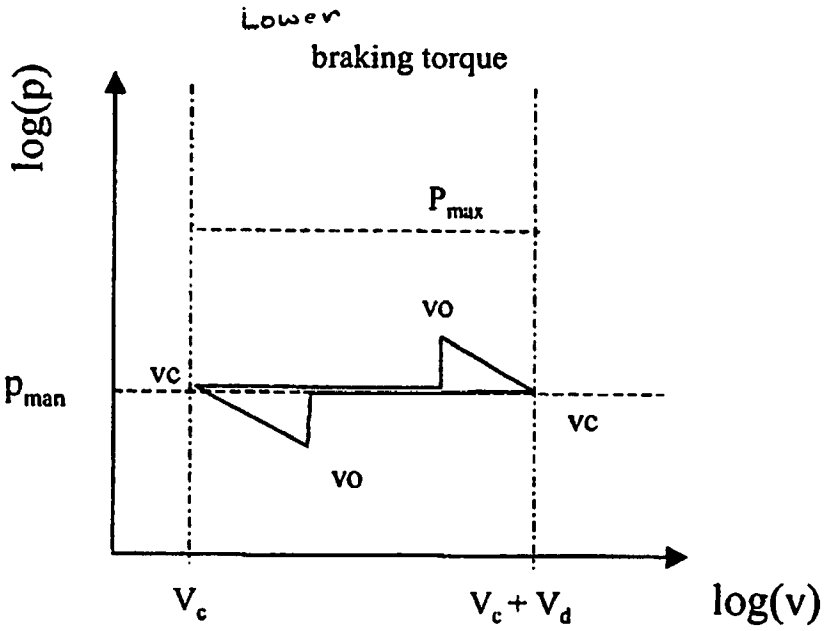
FIGS. 6A and 6B show engine braking increased via expansion and compression work.
Figure 6A:
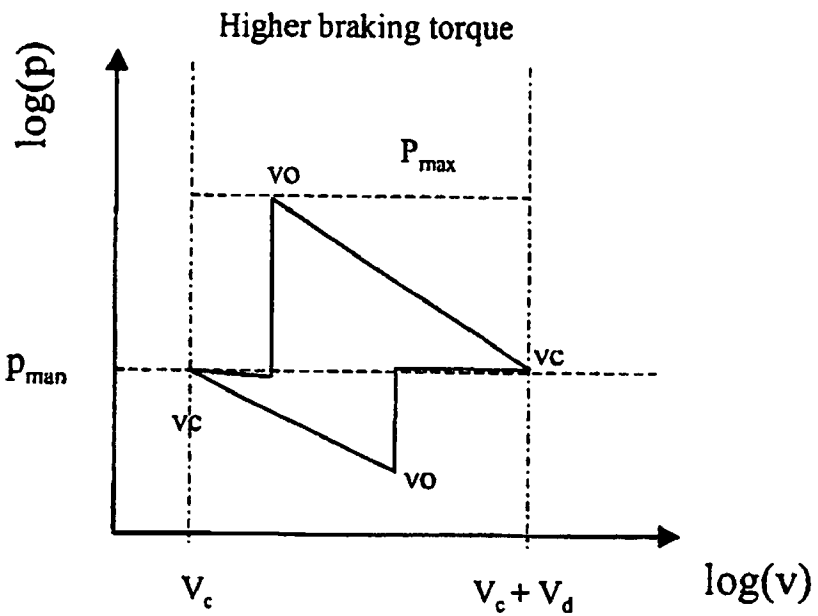

In still another alternative embodiment, it may be possible to combine both expansion and compression work. FIGS. 6A and 6B show an alternative which combines the features of those shown in FIGS. 4A, 4B, 5A, and 5B. Such an approach may be used to further increase the engine braking torque beyond. However, this approach may be limited to lower engine speeds due to potential minimum transition time to open/close the valve(s). In other words, the minimum opening duration may be a function of actuator transition time and engine speed and may determined the maximum spread of the valve closing times for the combined braking mode. Thus an approach using a combination of expansion and compression braking in the same cylinder may be used to generate higher braking torque at low engine speeds, while approaches using only one of expansion and compression braking in a given cylinder may be used at mid to high engine speeds. Also, the approach of combined expansion and compression braking may also be used to limit the peak pressures for a given brake torque level and thus reduce any adverse noise effects.

As noted above for either the compression or expansion braking example, various modifications can be made to valve opening/closing timing to vary the braking torque created. Further, the gasses may be moved into and out of the cylinder on either the intake or exhaust side.

Also, for any of the above approaches, only some of the cylinders may be operated to generate engine braking, while other cylinders are operated with all valves closed, or combusting and air-fuel mixture. Also, different cylinders can carry out different modes of engine braking.

Note that the implementation of expansion and/or compression braking may generate more engine brake torque than approaches that rely on engine pumping work (although this may be combined with the present approach, if desired). In such engine, the theoretical lower limit for net mean effective pressure NMEP while using fuel-cut would be on the order of −1 bar. This is in contrast to the scheme shown in FIGS. 4A, for example, where calculations indicate that the lower limit for NMEP would be about −5 or −6 bar for an engine with a compression ratio of 10. Thus the potential for reducing brake wear may be significant. For example, if one assumes 1st gear operation for a 2.0 L mid-size vehicle (13700 N, gear ratio=11.32), the additional engine braking could provide as much as 3900N of tractive force.

Note also that the above compression and/or expansion braking processes may occur in less than two strokes of a piston for that cylinder. As such, it may be possible to perform two braking cycles over a four-stroke cycle. Alternatively, only one braking cycle can be performed of four (or more) strokes, thereby spreading the torque over a greater crank angle and resulting in lower net engine braking.

Various examples illustrating at least some of the alternative embodiments, as well as other alternative embodiments, are shown in FIGS. 7A–7L. In each of the figures, an intake valve is indicated at (I) and an exhaust valve at (E). Further, piston motion is indicated, with a high level being towards top dead center (TDC) (i.e., towards the valves), and lower being towards bottom dead center (BDC). Also, the valve is shown moving from a fully closed position to fully opened position. However, the valve may open partially, or open to the mid (m) position, if desired.

In each example, a valve on one side of the engine (e.g., intake side, exhaust side) is maintained closed for a period, and during that period, a valve on the other side of the engine is moved from a closed position, to an open position (which may be fully opened, partially opened, etc.), and back to a closed position. The period can be fixed or variable. Further, the period can be a time period, a period defined by a number of rotation degrees of the engine, or left undefined to be determined by operating conditions or feedback from a sensor.

Figure 7A:
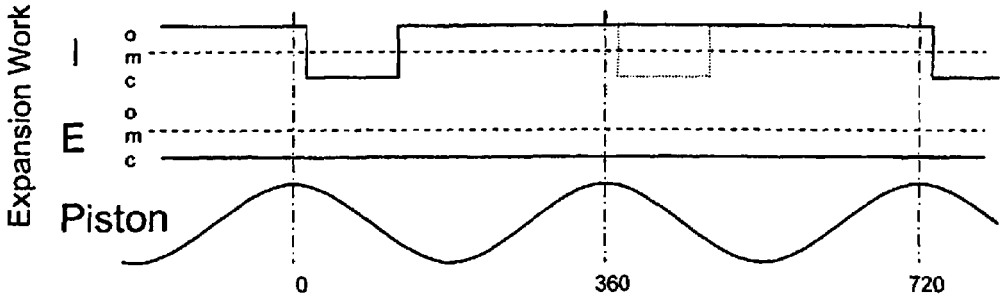
FIGS. 7A–7L, 8A–8B, and 10A–10B, show various example valve timing operations illustration expansion, compression, and combined, engine braking.
Figure 7B:
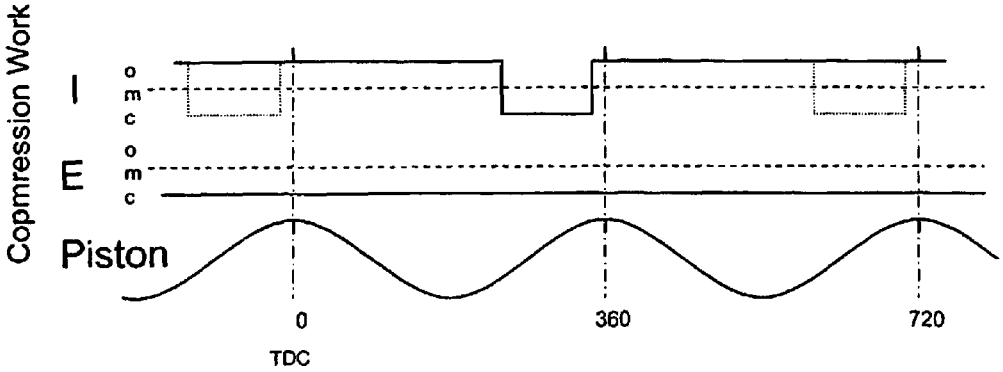
Figure 7C:
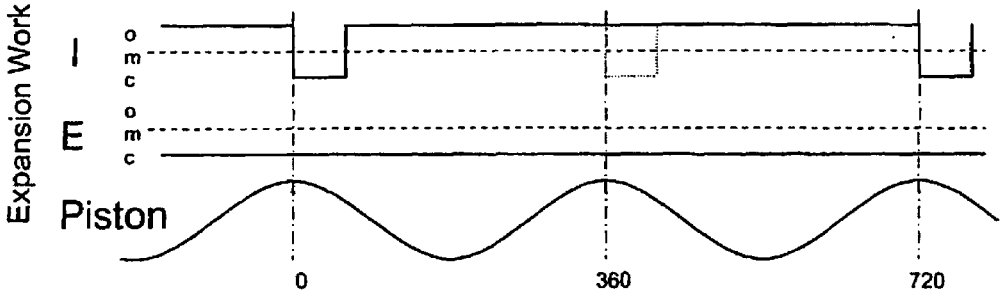

FIGS. 7A and 7C show examples where expansion work is performed every other downward stroke, or once per four strokes, on the intake side of the engine. In the examples illustrated, the expansion or compression work is done during a single stroke of a piston (e.g. between BDC and TDC), although in other examples it can be performed over more than a single stroke of the piston.

As indicated above, it may be possible to double the expansion work for a given valve timing by adding an additional expansion work cycle indicated by the dashed line. Alternatively, the expansion cycle can be performed every 3 stroke, every 5 stroke, or less often such as every 6, 7, or 8 strokes. Also, the example of FIG. 7A shows intake valve closing timing slightly after TDC, although it can be at TDC (e.g., see FIG. 7C) or before if desired (which may affect the generated brake torque). Further, the example of FIG. 7A shows the intake valve opening timing around 110 degrees after TDC (ATDC), although this can be made earlier (see FIG. 7C) or later to also vary the amount of brake torque generated.

Figure 7D:
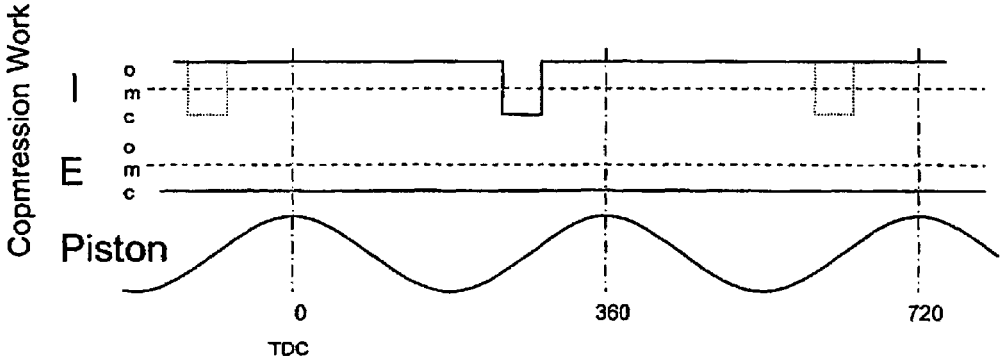
Figure 7E:
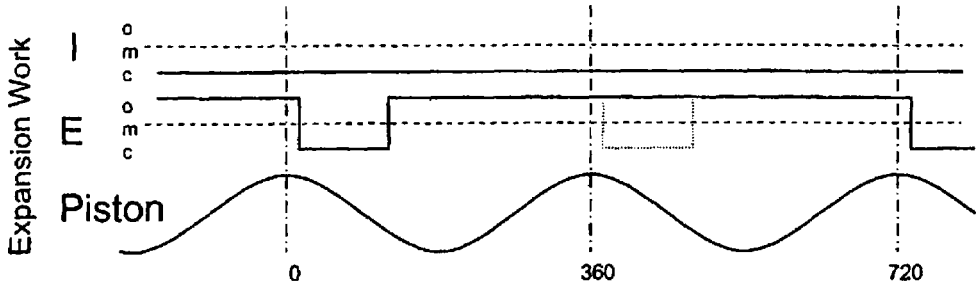
Figure 7F:
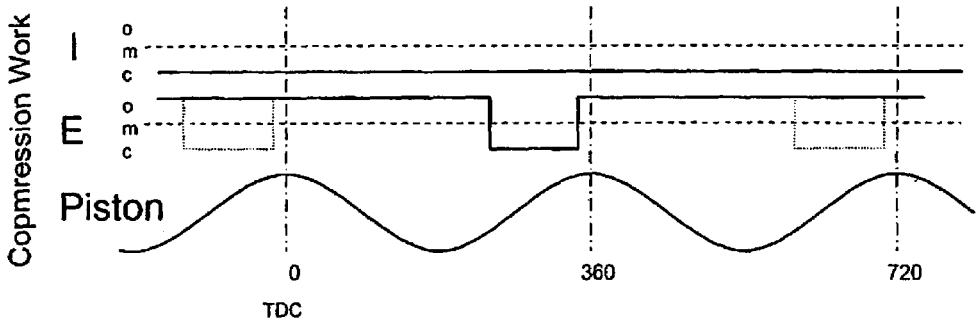
Figure 7G:
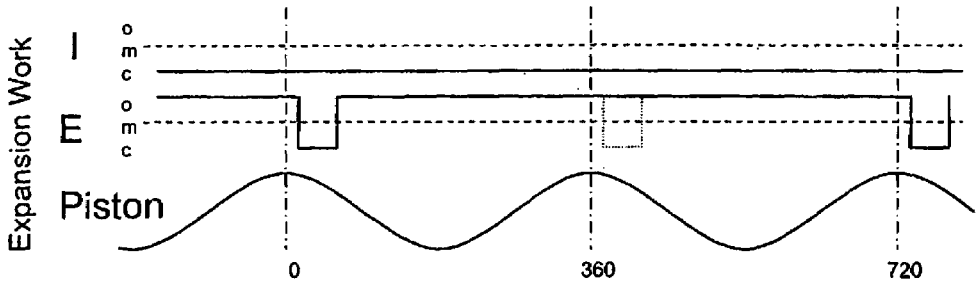
Figure 7H:
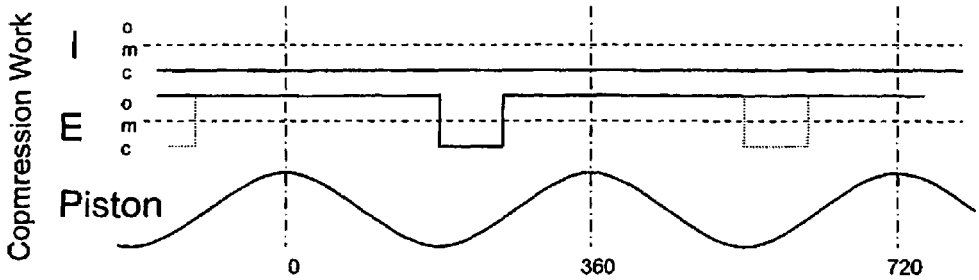
Figure 7I:
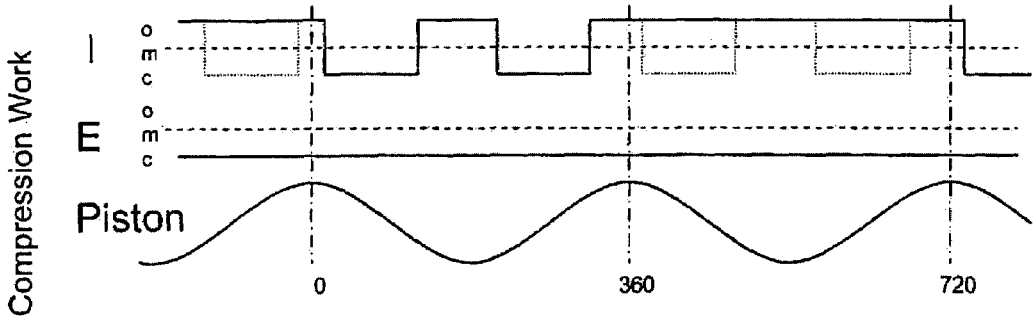
Figure 7J:
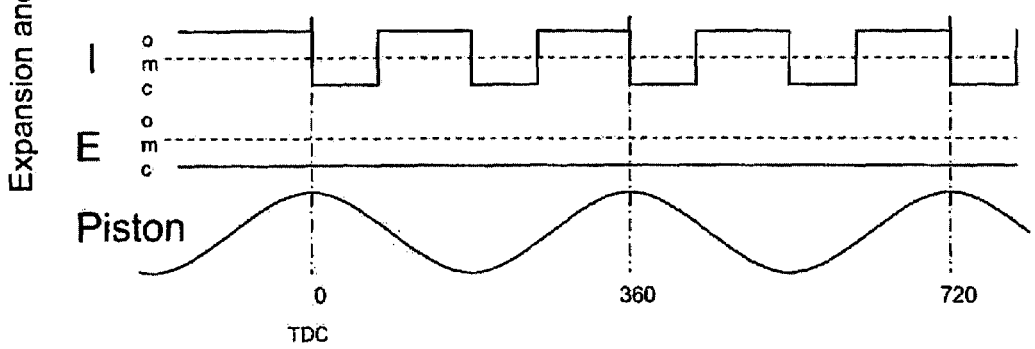
Figure 7K:
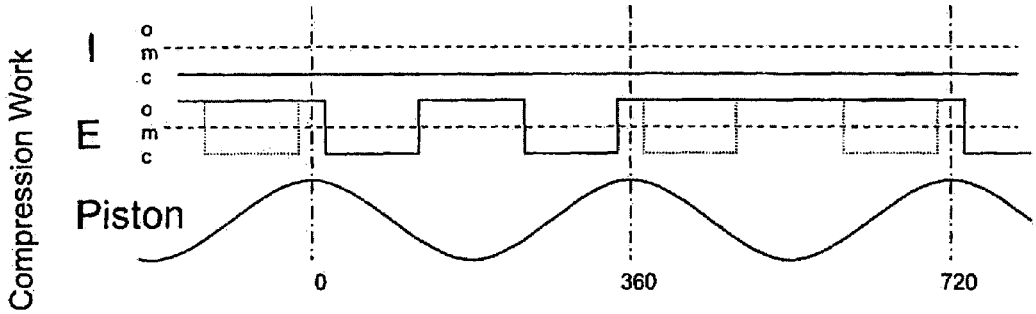
Figure 7L:
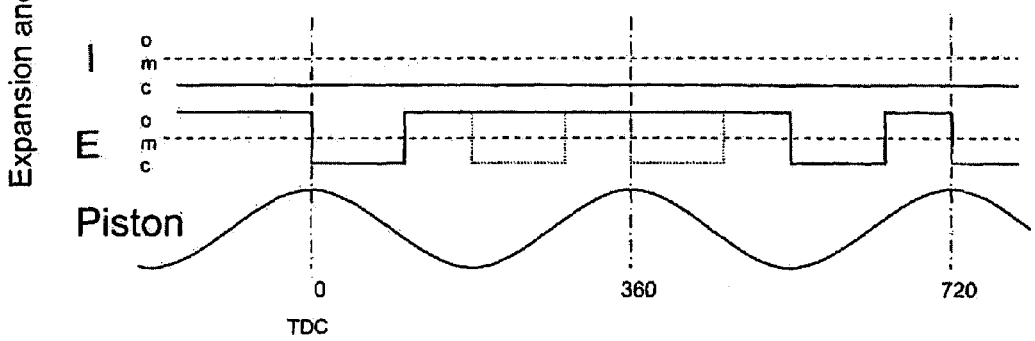

FIGS. 7B and 7D show examples where compression work is performed every other upward stroke, or once per four strokes, on the intake side of the engine. As indicated above, it may be possible to double the compression work for a given valve timing by adding an additional compression work cycle indicated by the dashed line. Alternatively, the compression cycle can be performed every 3 stroke, every 5 stroke, or less often such as every 6, 7, or 8 strokes. Also, the example of FIG. 7B shows intake valve closing timing after BDC, although it can be at BDC or before if desired (which may affect the generated brake torque). Further, the example of FIG. 7B shows the intake valve opening timing around 10 degrees before TDC (BTDC), although this can be made earlier (see FIG. 7D) or later to also vary the amount of brake torque generated.

FIGS. 7E, 7F, 7G, and 7H show examples where expansion or compression work is performed every other downward stroke, or once per four strokes, on the exhaust side of the engine. As indicated above, it may be possible to double the work for a given valve timing by adding an additional work cycle indicated by the dashed lines. Alternatively, the expansion cycle can be performed every 3 stroke, every 5 stroke, or less often such as every 6, 7, or 8 strokes. Again, for any of 7E through 7H, valve opening and/or closing timing may be adjusted to vary brake torque generation.

FIGS. 7I, 7J, 7K, and 7L show examples where expansion and compression work are combined on the intake side (I and J) or exhaust side (K and L) of the engine, for a given piston cycle. Again, for any of 7I through 7L, valve opening and/or closing timing may be adjusted to vary brake torque generation.

As stated above, in each of the figures, an intake valve is indicated at (I) and an exhaust valve at (E). Note however, that more than one intake or more than one exhaust valve may be used. In such a case, all of the intake or all of the exhaust valves may follow the timings indicated. Alternatively, in the case where there are 4 valves per cylinder (2 intakes and 2 exhausts), one group of valves may follow the timings indicated, while only one of the valves in the other group follows the timing indicated. For example, in any of the examples illustrated in FIG. 7, the valve that is opened and closed can be only one of the valves (while the other like valve is maintained closed), while the other side two valves are held closed. Thus, in the case of FIG. 7A where there are two intake valves and two exhaust valves, for example, both exhaust valves follow the E timing, while only one intake valve follows the I timing, and the other intake valve is maintained closed (at least during the opening of the other intake valve.

Figure 8A:
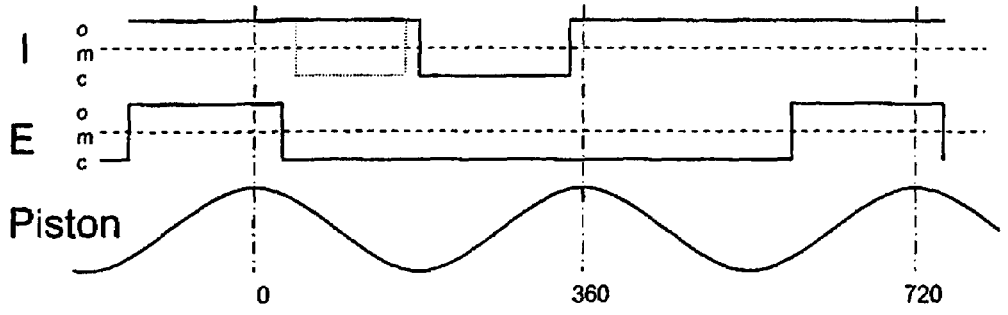
Figure 8B:
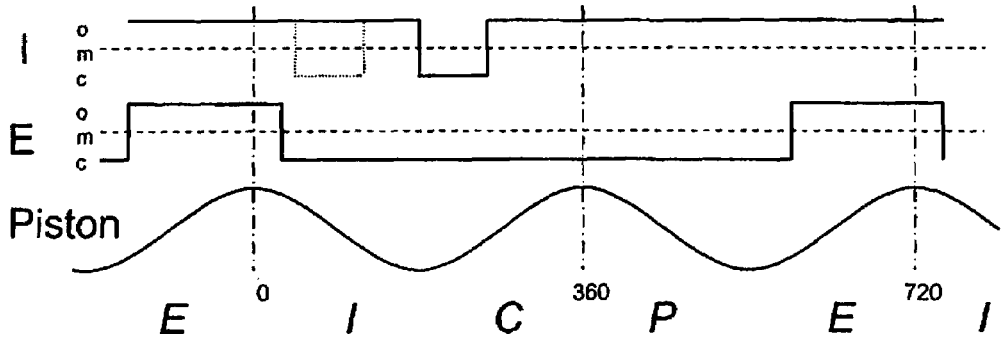

FIGS. 8A and 8B show an example where an electromagnetic intake valve(s) is used and a cam driven exhaust valve(s) is used. Here, an example exhaust cam timing is illustrated, although it can be varied as speed changes, or for different engine configurations. Even in the case of a mechanically driven exhaust valve, it may still be possible to obtain improved braking, while reducing net airflow through the engine. Further, by varying opening and/or closing timing of the intake valve, the brake torque level generated can be varied. To ease understanding, intake-compression-power-exhaust (I-C-P-E) labels are included, but it should be clear that these are only for reference for exhaust timing, not actually what is occurring in the cylinder.

Specifically, in one example, compression braking is used, although expansion braking may be used as illustrated by the dotted lines. Further, as noted in a previous example, the braking torque can be increased by performing a compression/expansion cycle on every available stroke, or by using a combination of expansion and compression braking (although these are not shown in FIG. 8).

Note that in any of the Figures herein, the valves may not move instantaneously as shown, as such the Figures show valve motion for illustrative purposes. Rather, valve opening and valve closing may take a variable amount of time or degrees.

Note that in some example embodiments, an electronically controlled throttle plate can be used in the engine. The throttle can be adjusted based on operating conditions to generate vacuum, if desired. Also, during expansion or compression braking on the intake side of the engine, the throttle plate can be closed, or partially closed, to reduce noise from passing out through the induction system.

Figure 9A:
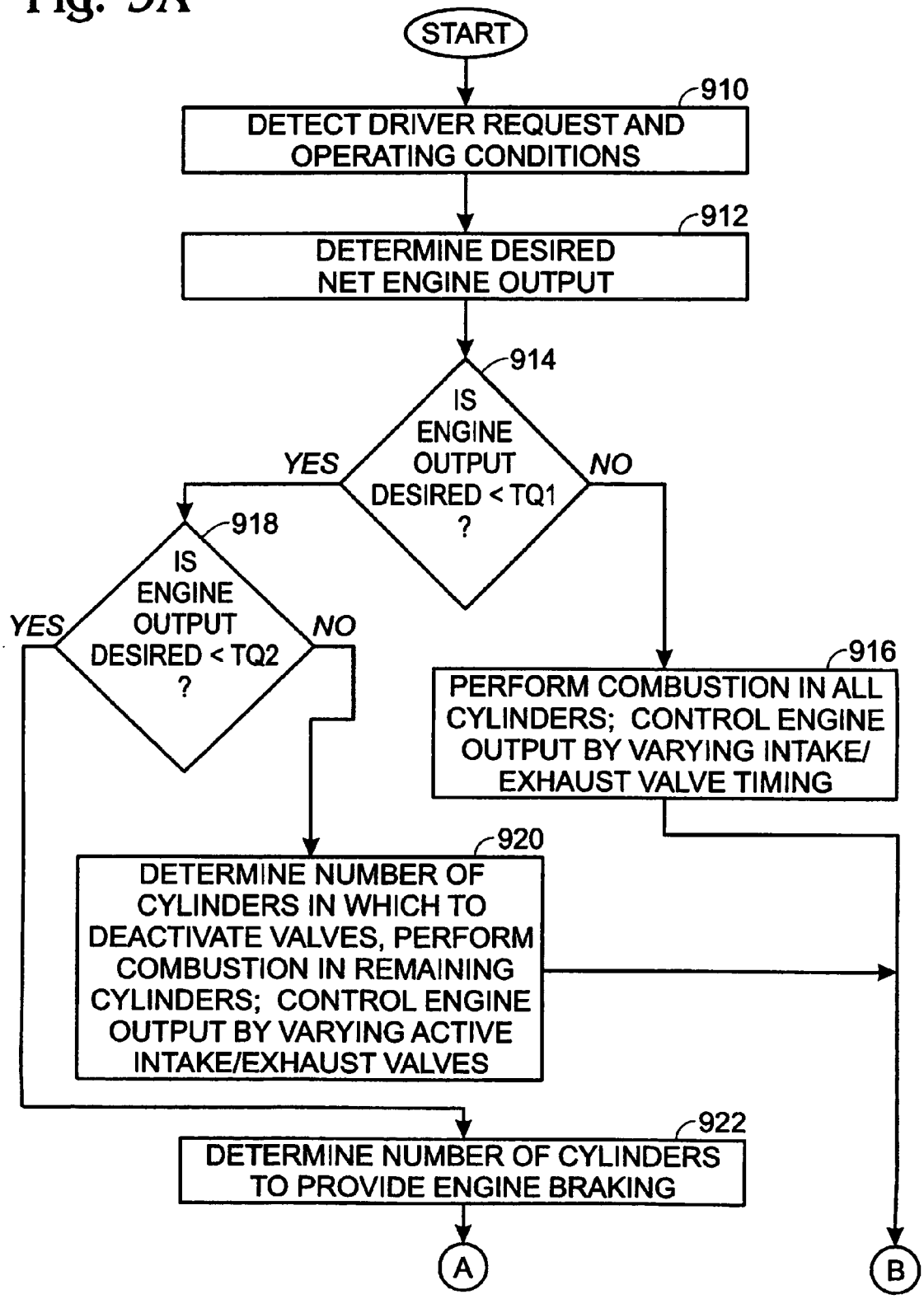
FIGS. 9A–9B shows an example high level routine for controlling engine operation.
Figure 9B:
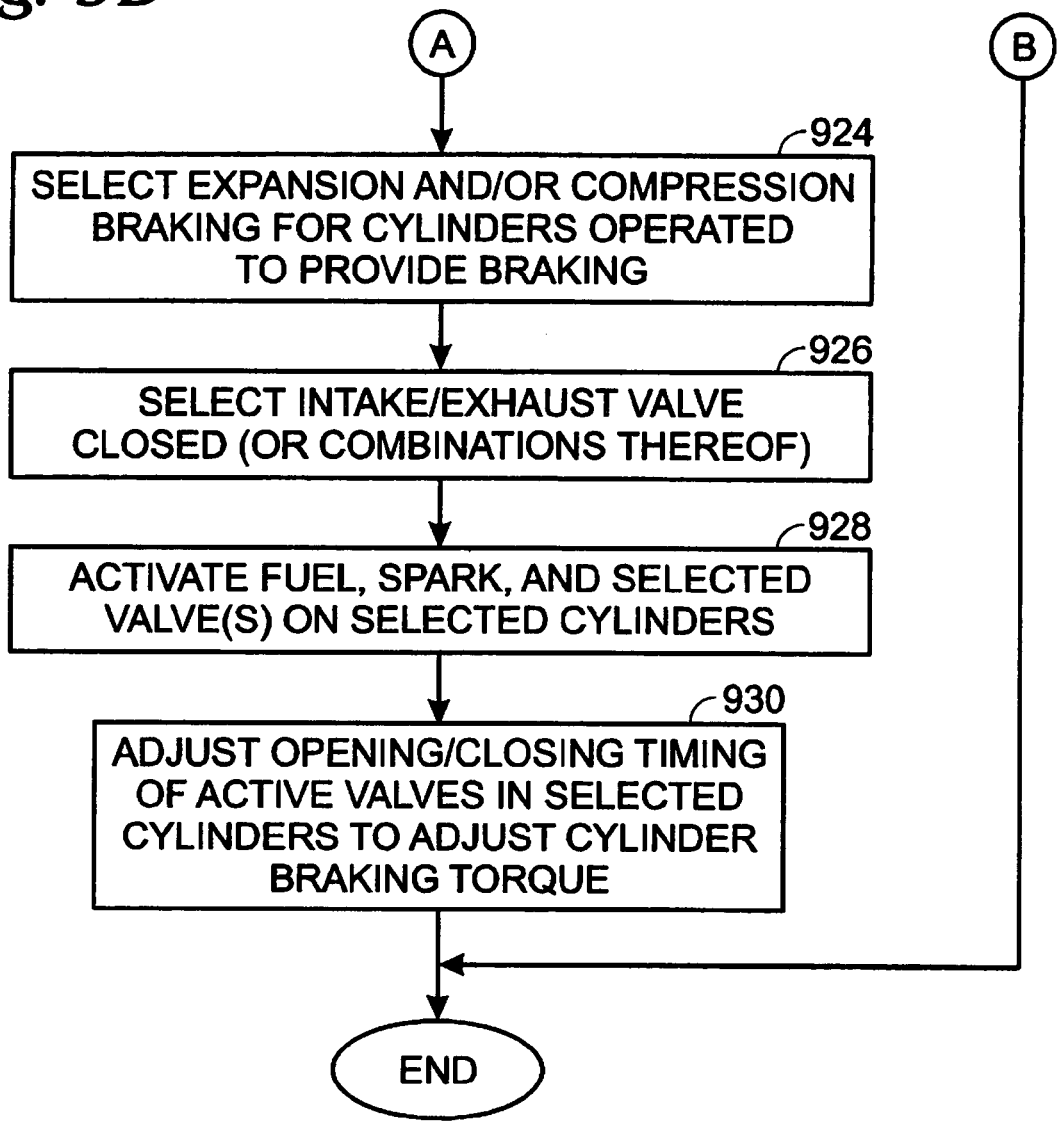
Figure 10A:
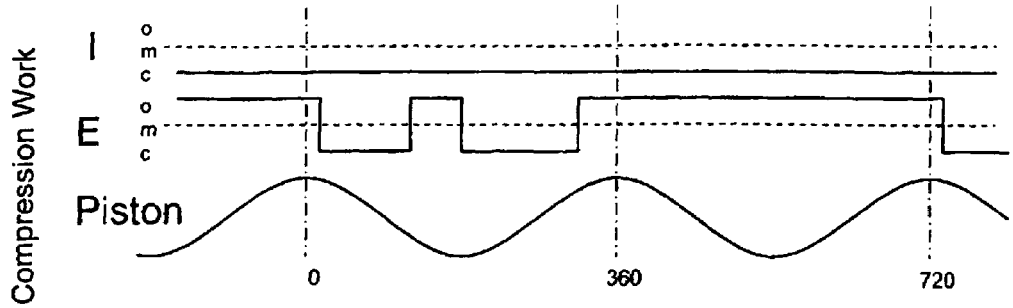
Figure 10B:
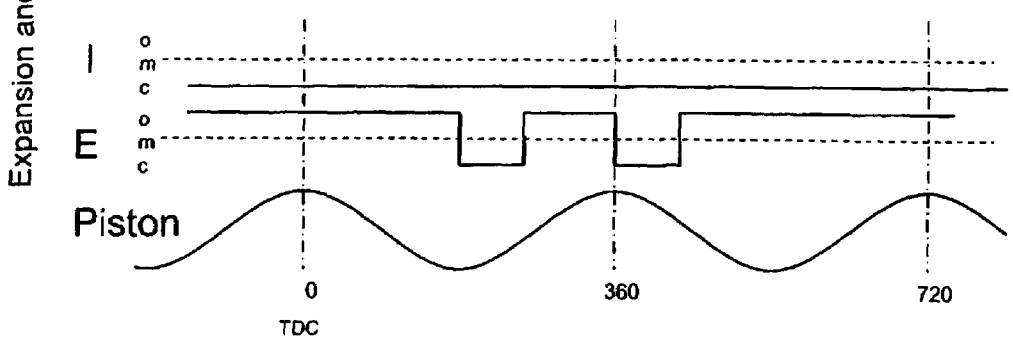

Referring now to FIGS. 9A and 9B, a routine is described for controlling engine braking during deceleration conditions. Note, however, that the approach illustrated may be used to control engine torque in response to a desired torque from the operator (or a cruise control system, or a traction control system, or combinations thereof), which may desire a negative engine torque value. An example traction control system that advantageously uses engine braking is described in more detail below with regard to FIGS. 21–24.

As will be appreciated by one of ordinary skill in the art, the specific routines described below in the flowcharts may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the features and advantages of the disclosure, but is provided for ease of illustration and description. Although not explicitly illustrated, one of ordinary skill in the art will recognize that one or more of the illustrated steps or functions may be repeatedly performed depending on the particular strategy being used. Further, these Figures graphically represent code to be programmed into the computer readable storage medium in controller 12.

Referring specifically to FIGS. 9A and 9B, in step 910, the routine detects a driver request, as well as other operating conditions such as engine speed, vehicle speed, temperature, etc. In one example, the driver's request is a requested wheel or engine torque based on pedal position and vehicle speed. Alternatively, it may be a desired acceleration. Further, the routine detects tip out conditions, which may be based on when a desired negative torque is requested, when the pedal position is less than a minimum threshold, when a desired deceleration is generated, or combinations thereof. Further, other parameters may be used to detect such conditions.

Next, in step 912, the routine determines desired net engine output (e.g., torque) from the driver's request. Further, additional parameters may be taking into account, such as traction control, cruise control, vehicle or engine operating conditions, degradation conditions, or combinations thereof.

In step 914, the routine determines whether the desired engine output, is less than a first limit. In this example, the routine determines whether the desired engine output torque is less than a first threshold TQ1, which may be zero, or a small or negative torque. Alternatively, it may be the output torque provided by deactivating all cylinder valves (e.g., friction torque). Still further, TQ1 may be a minimum possible torque available by combusting all cylinders at a minimum airflow.

When the answer to step 914 is NO, the routine continues to step 916 where combustion may be performed in all cylinders. Further, in this mode, engine output is controlled by varying the intake and/or exhaust valve timing, for example. From step 916, the routine continues to the end.

Alternatively, when the answer to step 914 is YES, the routine continues to step 918, where a determination is made as to whether the desired engine output, is less than a second limit. In this example, the routine determines whether the desired engine output torque is less than a second threshold TQ2, which may be less than TQ1. When the answer to step 918 is NO, the routine continues to step 920 where combustion may be performed in a reduce number of cylinders. Specifically, in step 920, the routine determines a number of cylinders in which to carry out combustion, and a number in which to deactivate valves, to provide the desired torque. Further, in this mode, engine output is controlled by varying the intake and/or exhaust valve timing of operating cylinders, for example. Further, negative torque may be controlled by controlling valve timings for deactivated cylinders, as described herein.

Alternatively, when the answer to step 918 is YES, the routine continues to step 922 where the routine determines a number of cylinders to provide engine braking torque. In one embodiment, the routine also determines the number of strokes between engine braking provided by compression or expansion work in a cylinder. In this way, it may be possible to vary not only valve timing to vary the braking torque achieved, but also vary the number of expansion and/or compression events in a given number of engine cycles to vary the cycle averaged engine braking torque.

Next, in step 924, the routine selects whether expansion braking, compression braking, or both, are selected for any of the cylinders selected to provide engine braking action via expansion or compression work. Note that each cylinder can be operated with a common approach, or different cylinders can provide different types of braking, if desired. Then, in step 926, the routine selects whether intake and/or exhaust valve actuation may be used to provide expansion or compression work in the selected cylinders. Again note that each cylinder can be operated with a common approach, or different cylinders can provide intake and/or exhaust side braking, if desired.

Then, in step 926, the routine continues to step to deactivate fuel, spark and the selected valves to provide the desired engine braking mode(s). Finally, in step 928, the routine adjusts the opening and/or closing timing of the active valves on the selected cylinder to vary the respective braking torque of the cylinders to desired values. Then, the routine ends.

This illustrates one example approach for smoothly and continuously controlling the braking torque, which may allow improved engine braking and vehicle control.

Thus, while this routine illustrates one embodiment, various others can be used. For example, a routine can be used which controls vehicle acceleration or deceleration rate of the vehicle using the measured vehicle speed. Alternatively, a routine can be used in which a desired deceleration rate is based on vehicle speed, and then the engine braking is adjusted to maintain or achieve the desired deceleration rate. Further, valve timings can be adjusted to provide more braking at higher speeds, and more braking at higher acceleration rates.

In one example, engine braking torque may be controlled by controlling the intake and/or exhaust valve timing to deliver a desired level of compression, expansion, or both. In the following example embodiment, exhaust valve opening timings for the compression, expansion, and combined mode are developed. However, these same techniques could be used to develop closing timing, intake valve (opening/closing) timings, or combinations thereof.

Note that, as described above, different engine braking techniques can be used in different situations. For example, in conditions where high engine braking is used, a portion or all of the engine cylinders can be operated with intake and/or exhaust side compression (optionally in combination with expansion) braking to generate desired high levels of engine braking. Alternatively, in conditions in which low engine braking is used, only expansion (intake or exhaust side) braking (in some or all of the cylinders) can be used to reduce noise while still providing desired braking. In this way, improved overall performance may be achieved. Also, as noted, in different operating modes, different numbers and selected cylinders may be operated in an engine braking mode, while other cylinders are operated with all intake/exhaust valves closed without carrying out combustion (i.e., without expansion/compression braking). In this way, greater brake torque resolution may be achieved. While desired torque is one operating condition that may be used in selected between any or all of the above braking modes and combinations, other parameters may be used, such as engine speed, vehicle speed, vehicle acceleration, driver pedal position, engine airflow, or combinations thereof. Thus, the following are example modes that may be use:

- some cylinders operating with intake side expansion braking, and other cylinders operating with all intake and exhaust valves closed and without combustion or fuel injection;
- some cylinders operating with exhaust side expansion braking, and other cylinders operating with all intake and exhaust valves closed and without combustion or fuel injection;
- some cylinders operating with exhaust side compression braking, and other cylinders operating with all intake and exhaust valves closed and without combustion or fuel injection;
- some cylinders operating with intake side compression braking, and other cylinders operating with all intake and exhaust valves closed and without combustion or fuel injection;
- some cylinders operating with intake side expansion braking, and other cylinders operating with either the intake or exhaust valves closed, and the other of the intake or exhaust valves open throughout at least two (or more) revolutions of the crankshaft and without combustion or fuel injection;
- some cylinders operating with exhaust side expansion braking, and other cylinders operating with either the intake or exhaust valves closed, and the other of the intake or exhaust valves open throughout at least two (or more) revolutions of the crankshaft and without combustion or fuel injection;
- some cylinders operating with intake side compression braking, and other cylinders operating with either the intake or exhaust valves closed, and the other of the intake or exhaust valves open throughout at least two (or more) revolutions of the crankshaft and without combustion or fuel injection; some cylinders operating with exhaust side compression braking, and other cylinders operating with either the intake or exhaust valves closed, and the other of the intake or exhaust valves open throughout at least two (or more) revolutions of the crankshaft and without combustion or fuel injection;
- some cylinders operating with exhaust side expansion braking, and others operating with exhaust side compression braking;
- some cylinders operating with intake side compression braking, and others operating with exhaust side compression braking;
- some cylinders operating with intake side expansion braking, and others operating with exhaust side compression braking; some cylinders operating with intake side expansion braking, and others operating with intake side compression braking;
- some cylinders operating with exhaust side expansion braking, and others operating with intake side compression braking;
- some cylinders operating with exhaust side compression braking, and others operating with intake side compression braking;
- some cylinders operating with intake side expansion braking, and others operating with exhaust side expansion braking;
- cylinders operating with intake side expansion braking during a first set of conditions, and cylinders operating with all intake and exhaust valves closed and without combustion or fuel injection during a second set of conditions;
- cylinders operating with exhaust side expansion braking during a first set of conditions, and cylinders operating with all intake and exhaust valves closed and without combustion or fuel injection during a second set of conditions;

cylinders operating with exhaust side compression braking during a first set of conditions, and cylinders operating with all intake and exhaust valves closed and without combustion or fuel injection during a second set of conditions;

cylinders operating with intake side compression braking during a first set of conditions, and cylinders operating with all intake and exhaust valves closed and without combustion or fuel injection during a second set of conditions; cylinders operating with intake side expansion braking during a first set of conditions, and cylinders operating with either the intake or exhaust valves closed, and the other of the intake or exhaust valves open throughout at least two (or more) revolutions of the crankshaft and without combustion or fuel injection during a second set of conditions;

cylinders operating with exhaust side expansion braking during a first set of conditions, and cylinders operating with either the intake or exhaust valves closed, and the other of the intake or exhaust valves open throughout at least two (or more) revolutions of the crankshaft and without combustion or fuel injection during a second set of conditions;

cylinders operating with intake side compression braking during a first set of conditions, and other cylinders operating with either the intake or exhaust valves closed, and the other of the intake or exhaust valves open throughout at least two (or more) revolutions of the crankshaft and without combustion or fuel injection during a second set of conditions;

cylinders operating with exhaust side compression braking during a first set of conditions, and cylinders operating with either the intake or exhaust valves closed, and the other of the intake or exhaust valves open throughout at least two (or more) revolutions of the crankshaft and without combustion or fuel injection during a second set of conditions;

cylinders operating with exhaust side expansion braking during a first set of conditions, and cylinders operating with exhaust side compression braking during a second set of conditions; cylinders operating with intake side compression braking during a first set of conditions, and cylinders operating with exhaust side compression braking during a second set of conditions;

cylinders operating with intake side expansion braking during a first set of conditions, and cylinders operating with exhaust side compression braking during a second set of conditions;

cylinders operating with intake side expansion braking during a first set of conditions, and cylinders operating with intake side compression braking during a second set of conditions;

cylinders operating with exhaust side expansion braking during a first set of conditions, and cylinders operating with intake side compression braking during a second set of conditions;

cylinders operating with exhaust side compression braking during a first set of conditions, and cylinders operating with intake side compression braking during a second set of conditions;

cylinders operating with intake side expansion braking during a first set of conditions, and cylinders operating with exhaust side expansion braking during a second set of conditions.

Also, on one embodiment, a characterization of the exhaust valve timing vs. average torque per cylinder may be used. Simulation results of the EVA engine under exhaust valve compression and expansion torque control are presented. These results are used to further develop a map between the exhaust valve opening timing, EVO, and the resulting braking torque by adjusting the average torque per cylinder models. Finally an EVO vs. average compression or expansion torque map development procedure is presented.

In one example, the compression braking work described above can be achieved by setting the exhaust valve closing timing, EVC, to close the exhaust valves near BDC, to maximize the trapped air volume, and by controlling the exhaust valve opening timing, EVO, to control the compression pressure and the resulting negative torque per cylinder. Also, as noted above, this exhaust valve timing method can be used in a 2-stroke mode (i.e., two compression cycles over a four stroke cycle) to further increase the compression torque per cylinder for a given maximum valve opening, blow-off, pressure or in a 4-stroke mode (e.g., one compression cycle over a four stroke cycle), or more. For example, a 4-stroke mode it can be used in cases where the 4-stroke mode provides improved low torque resolution or when the minimum valve open duration prevents the use of the 2-stroke mode, e.g. at high engine speeds.

The expansion braking work, on the other hand, can be achieved by setting the exhaust valve closing timing, EVC, to close the exhaust valves near TDC, to minimize the trapped air volume, and by controlling the exhaust valve opening timing, EVO, to control the expansion pressure and the resulting negative torque per cylinder. This exhaust valve timing method can also be used in 2-stroke mode to increase the expansion torque per cylinder for a given EVO timing, or in 4 (or more) -stroke mode. For example a 4-stroke mode can b used in cases where the 4-stroke mode provides improved low torque resolution or when the minimum valve open duration prevents the use of the 2-stroke mode, e.g. at high engine speeds.

The mixed compression/expansion mode can be implemented by combining the valve timing from compression work when the piston is moving up with the valve timing of expansion work when the piston is moving down. Also, as noted in FIGS. 10A and 10B, different types of valve timings can be used to generate both compression and expansion torque in a 720 degree cycle. Further, potentially both compression or expansion can be used to generate negative torque each time the piston moves from TDC to BDC and back. Note, however, that the potentially short open durations between expansion and compression or vise versa make this more difficult as engine speed increases. Also, as noted in FIGS. 10A and 10B, the valve timings can be varied to vary the level of engine braking torque.

Also, in still another example, a cylinder can alternatively (every cycle, or every few cycles) switch between compression and expansion braking to reduce potential oil migration into the cylinder.

Next, a method to convert desired average compression/expansion torque to a desired EVA exhaust valve timing is developed. Note that this is just one example approach, and other approaches could be used, such as basing the map on engine testing data. To produce a desired engine or vehicle response by controlling the exhaust valve timing as described above for this embodiment, either feedback or feed-forward techniques may be used, for example. If feedback is used then EVO and EVC are controlled as a function of an error state, such as the error in demanded torque, vehicle or wheel or engine deceleration or velocity. If feed-forward is used (either alone or in addition to feedback control) then EVO and EVC are at least partially controlled in an open loop manner using a mapping between compression and/or expansion torque and EVO, EVC and an engine operating point. The following examples show the development of a feed-forward technique for scheduling EVO as a function of desired compression or expansion torque.

The relationship between average compression/expansion torque per cylinder vs. EVO can be developed by starting with the ideal gas pressure equation for an open thermodynamic system, Eqs. (1), and eliminating the terms that may not apply while the valves are closed.

$$\dot{P} = \frac{R}{V}(\dot{m}_{in}\gamma_{in}T_{in} - \dot{m}_{out}\gamma_{out}T_{out}) - \gamma_{vol}\frac{P\dot{V}}{V} + \frac{(\gamma_{vol}-1)}{V}(q_w + q_{hr}) \quad (1)$$

As the valves are closed, the mass flow rate terms can be assumed to be nearly zero. Further there is no combustion, which gives, Eq. (2).

$$\dot{P} = \gamma_{vol}\frac{P\dot{V}}{V} + \frac{(\gamma_{vol}-1)}{V}q_w \quad (2)$$

Where $q_w$ is the heat transfer between the gas in the cylinder and the piston and cylinder walls, P is pressure, V is the cylinder volume, and $\gamma_{vol}$, is the polytropic constant. If the heat transfer is neglected, Eq. (2) can be reduced to the closed volume adiabatic expansion equation:

$$P = P_0\left(\frac{V_0}{V}\right)^{\gamma_{vol}} \quad (3)$$

Using Eq (3) and the torque per cylinder due to cylinder pressure, a known expression for the average torque per cylinder, over a 360 degree cycle can be derived.

$$T_{cyl} = \frac{1}{2\pi}\int_{\theta_1}^{\theta_2} L_{eff}PA_{pist}\,d\theta = \frac{1}{2\pi}\int_{\theta_1}^{\theta_2} L_{eff}P_0\left(\frac{V_0}{V}\right)^{\gamma_{vol}}A_{pist}\,d\theta \quad (4)$$

Where $A_{pist}$ is the piston area, $\theta_1$ is $\pi$ for compression and zero for expansion, $\theta_2$ is $3\pi$ for compression and $2\pi$ for expansion, and V is the piston volume, which is given by:

$$V = V_0 + A_{pist}x_p;\quad x_p = L_J(1-\cos\theta) + L_{cr}(1-\cos\gamma) \quad (5)$$

$$\sin\gamma = \frac{L_J}{L_{cr}}\sin\theta$$

and $L_{eff}$ is given by:

$$L_{eff} = \left(L_J\sin\theta + \frac{L_J\left(\frac{L_J}{L_{cr}}\right)\sin\theta\cos\theta}{\sqrt{1-\left(\frac{L_J}{L_{cr}}\sin\theta\right)^2}}\right) \quad (6)$$

where $V_0$ is the cylinder clearance volume, $L_J$ is the crankshaft center to connecting journal pin center length and $L_{cr}$ is the connecting rod length and $\theta$ is the crankshaft angle for the individual cylinder. By equating the crankshaft angle $\theta$ to the valve timing angle for each cylinder, combining Eqs. (3) through (6) and assuming that the cylinder pressure, P, at EVC is equal to the exhaust manifold pressure, it is possible to calculate the relationship between average compression and/or expansion torque and EVO over the 360 degree period between $\theta_1$ and $\theta_2$. Further the period before or after $\theta_1$ to $\theta_2$ in 4 stroke mode, when the exhaust valve is open, can be accounted for by noting that Equ. (4) is equal to zero if the cylinder pressure is constant.

Figure 11:
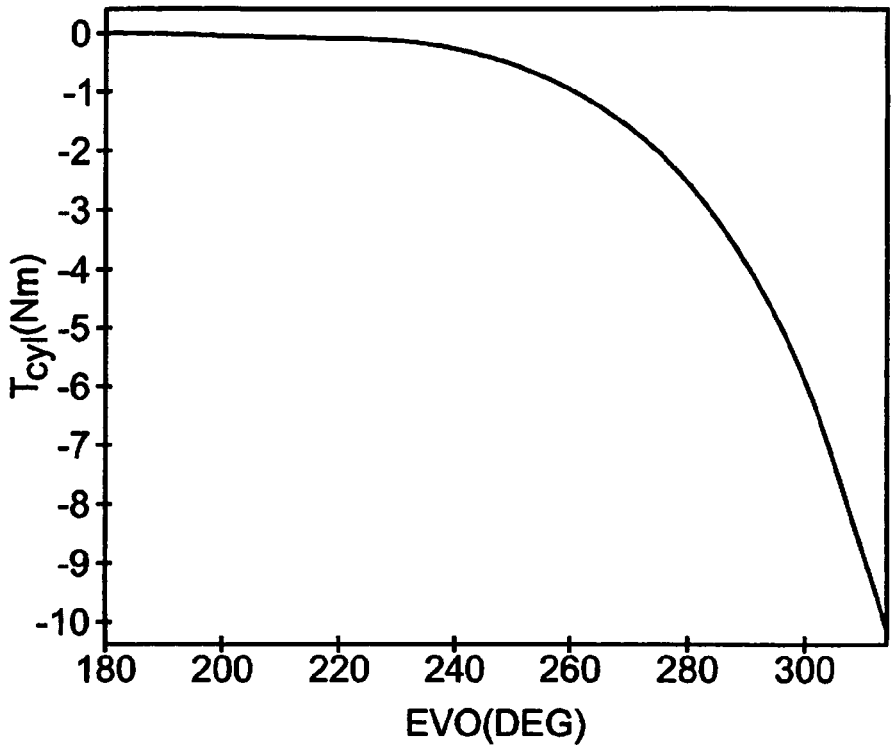
FIG. 11 shows average compression torque on the exhaust side vs. EVO over a 360 degree cycle, with exhaust valve closing (EVC)=180 Degrees.

Setting $\theta_1$ equal to $\pi$, $\theta_2$ equal to $3\pi$, P equal to $P_{exh}$ when the valve is open, and a maximum blow-off pressure of 7 Bar for the EVA engine, FIG. 11 shows Tcyl, average compression torque, vs. EVO curve can be calculated. Likewise, with $\theta_1$ equal to zero, $\theta_2$ equal to $2\pi$, P equal to $P_{exh}$ when the valve is open, for the EVA engine, FIG. 12 shows Tcyl, average expansion torque, vs. EVO curve can be calculated.

Figure 12:
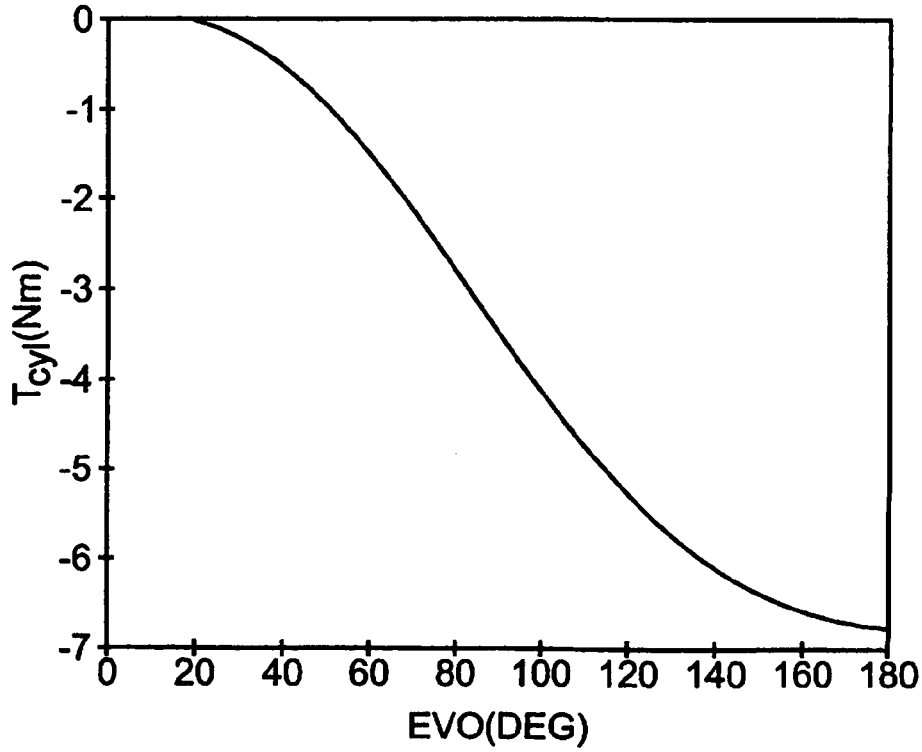
FIG. 12 shows average expansion torque on the exhaust side vs. EVO over a 360 degree cycle, with EVC= Zero Degrees.

Using tables of EVO vs. Tcyl for both compression and expansion torque, derived from FIGS. 11 and 12, a Tcyl to EVO map can be integrated into an EVA engine simulation to illustrate that the above example algorithm(s) may be used to control the compression and or expansion torque in an EVA engine. The simulation model may be formed by incorporating the equations described herein.

Figure 13:
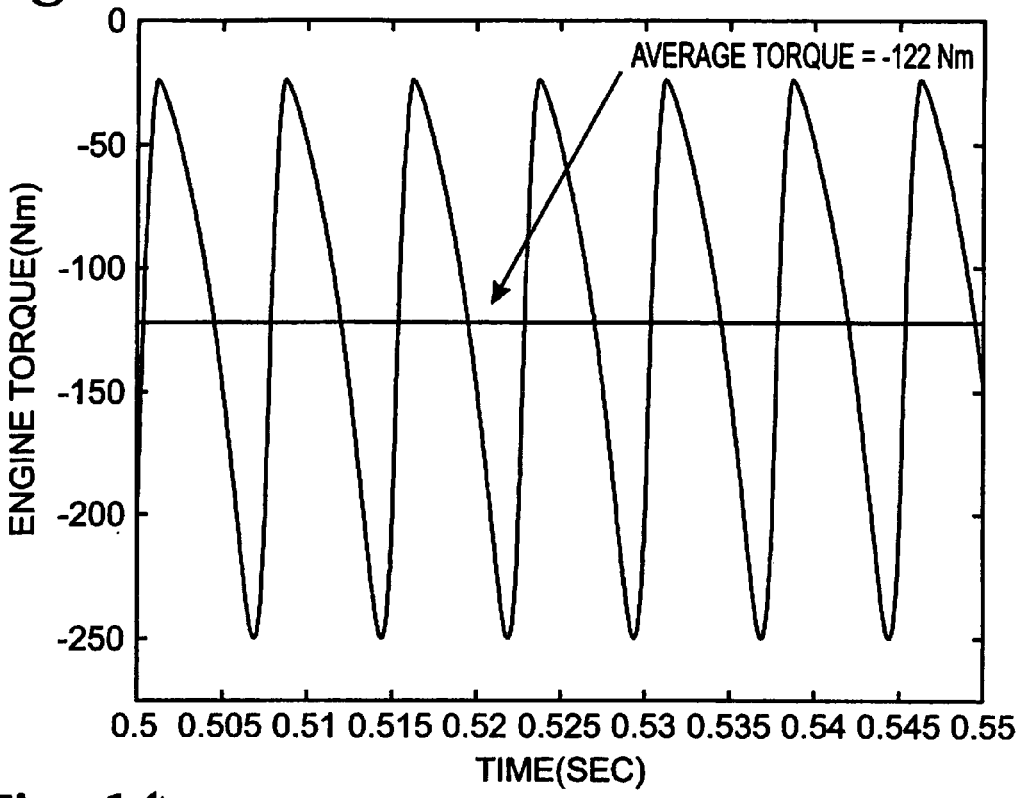
FIG. 13 shows Maximum EVA Comp. Torque at 2000 RPM.
Figure 14:
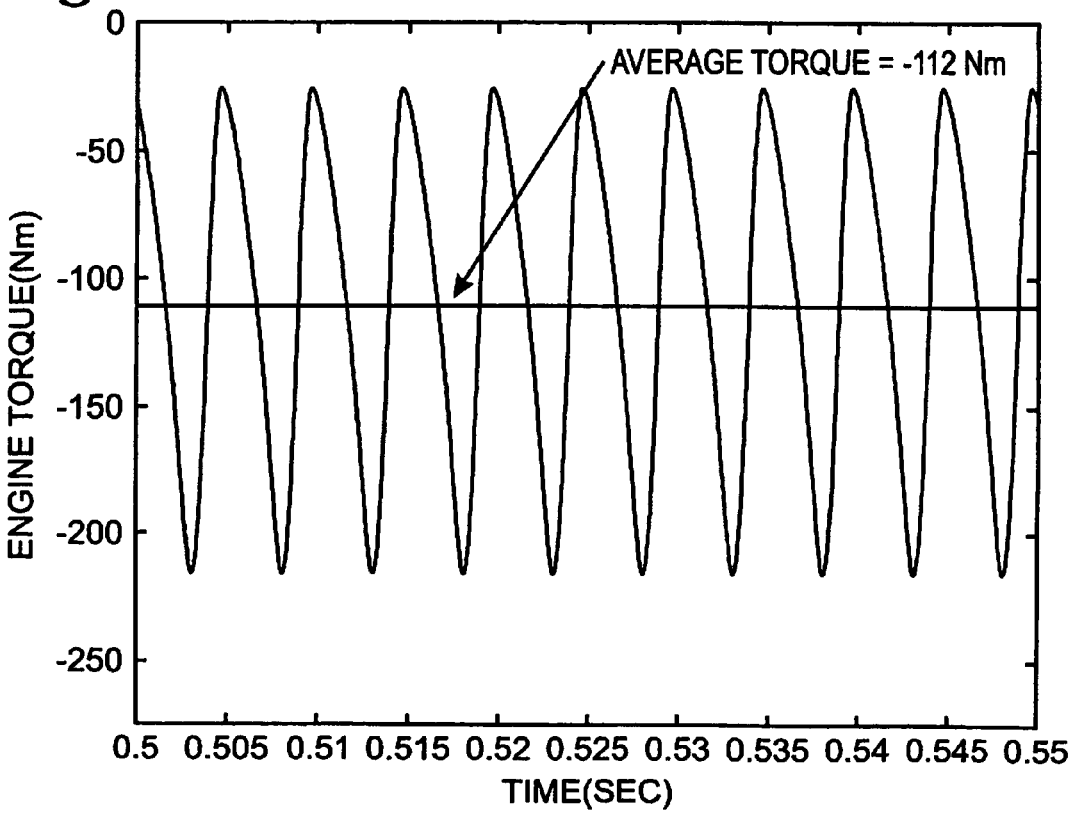
FIG. 14 shows Maximum EVA Comp. Torque at 3000 RPM.

In FIGS. 13 and 14, the maximum average compression torque Tcyl is −122 Nm at 2000 RPM and −112 Nm at 3000 RPM. The difference between these values and the expected value of 8*−10.25 Nm=−82 Nm, from FIG. 11, may be due to the assumption that the cylinder pressure immediately drops to Pexh when the exhaust valve is opened. This can be corrected by adding a pressure blow down model to the compression Tcyl vs. EVO calculation, if desired, as shown below.

A pressure blow down model may be developed using a cosine function to approximate the pressure drop from the pressure at EVO to the exhaust pressure over a duration, $\theta_{Dur}$, which can either be fixed or a function of engine speed and other engine operating parameters. The blow down pressure model is given by:

$$\text{if } ((\theta - EVO) \le \pi) \text{ then} \quad (7)$$

$$P = \frac{(P_{EVO} - P_{exh})}{2}\left(1 + \cos\left((\theta - EVO)\frac{\pi}{\theta_{Dur}}\right)\right) + P_{exh};\ \text{else } P = P_{exh}$$

Figure 15:
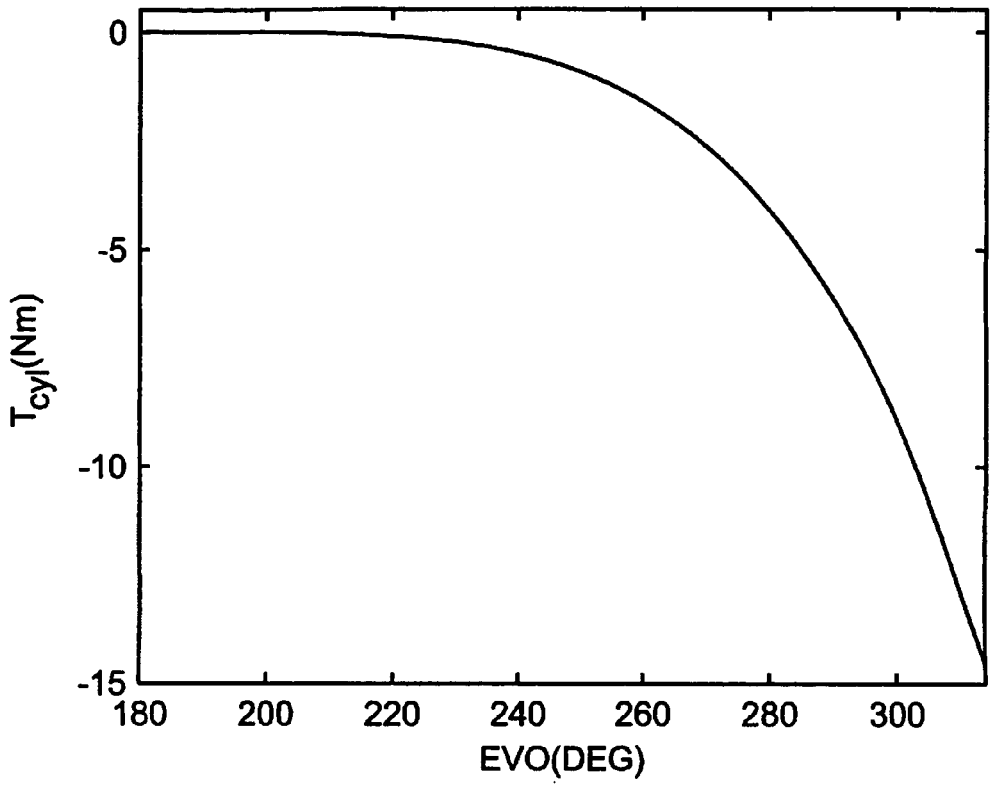
FIG. 15 shows average compression torque (Tcyl) vs. exhaust valve opening (EVO) over a 360 Degree Cycle, with Blow-Off Adjustment and EVC=180.

The compression $T_{cyl}$ vs. EVO curve in FIG. 15 may be generated by adding a pressure blow down model to the $T_{cyl}$ vs. EVO calculation with a fixed $\theta_{Dur}$ of 28 degrees, resulting in a maximum average compression torque for 8 cylinders of −117 Nm.

Figure 16A:
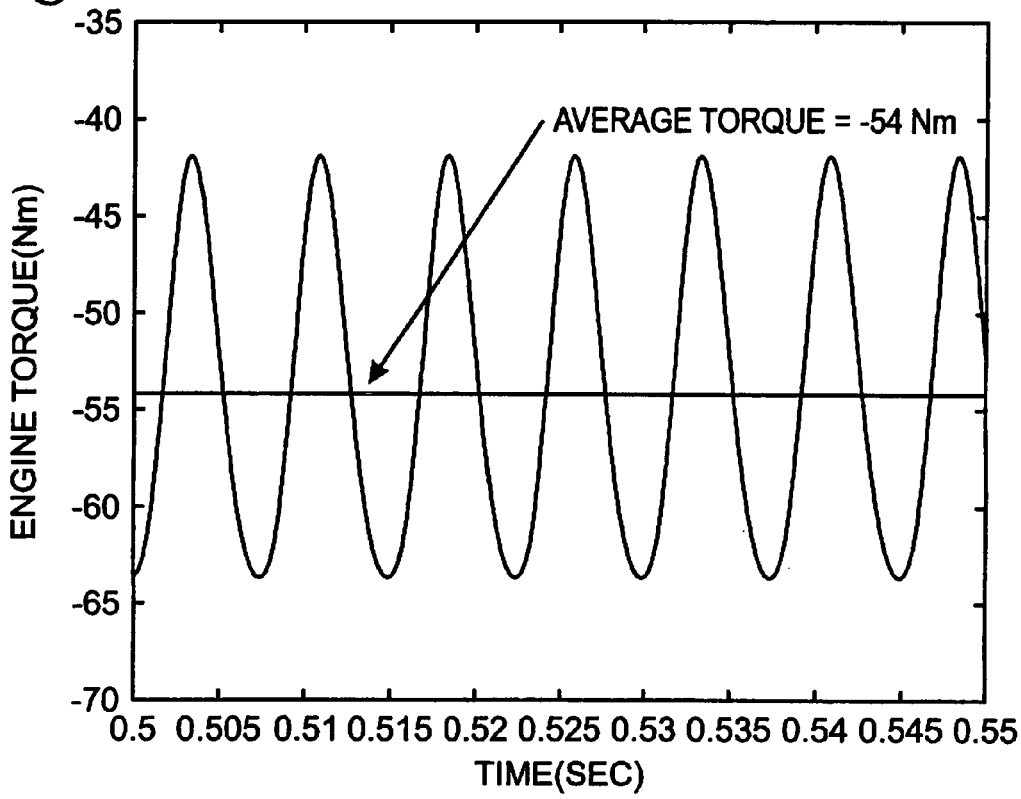
FIG. 16A shows Maximum EVA Exp. Torque at 2000 RPM.
Figure 16B:
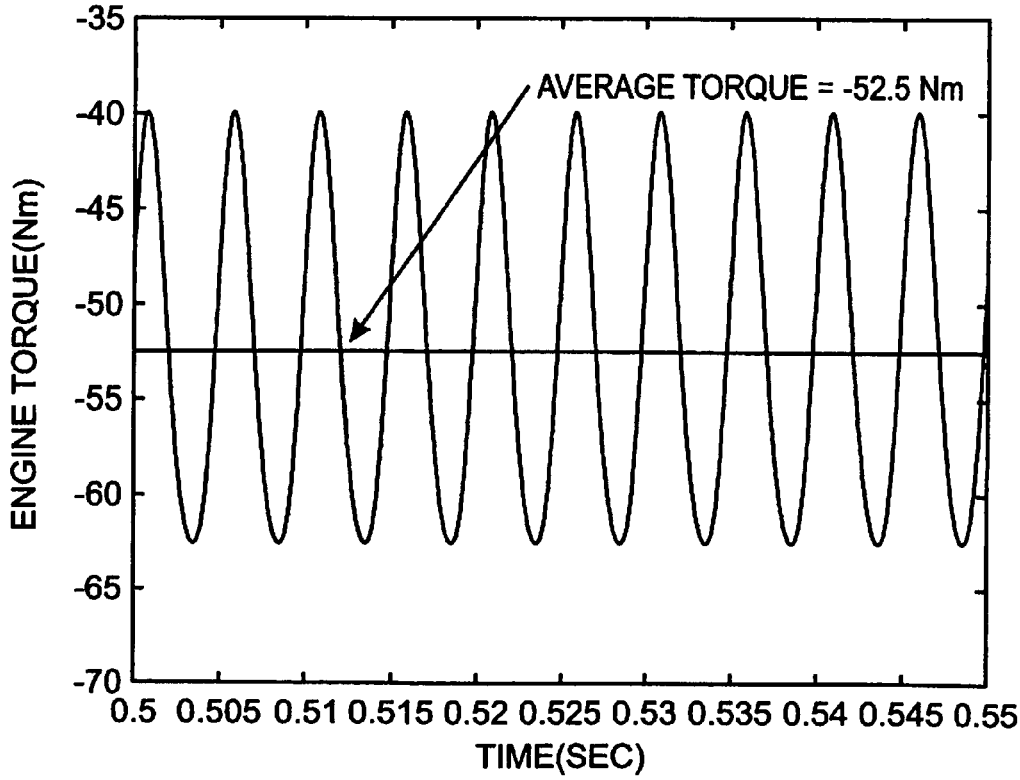
FIG. 16B shows Maximum EVA Exp. Torque at 3000 RPM.

In FIGS. 16A and 16B, the maximum average expansion torque Tcyl is −54 Nm at 2000 RPM and −52.5 Nm at 3000 RPM, which is equal to or close to the expected value of 8*−6.75 Nm=−54 Nm, from FIG. 12, yet the maximum values at 2000 and 3000 RPM occur at 150 degrees after TDC vs. 180 degrees after TDC as shown in FIG. 12. The discrepancy between Tcyl vs EVO form the simulation vs. the prediction from FIG. 12 may be due to the assumption that the cylinder pressure immediately rises to Pexh when the exhaust valve is opened. This can be corrected by adding a pressure rise model to the expansion Tcyl vs. EVO calculation.

A pressure rise model for the expansion cycle may be developed using a cosine function to approximate the pressure rise from the pressure at EVO to the exhaust pressure over a duration, $\theta_{Dur}$, which can either be fixed or a function of engine speed and other engine operating parameters. The pressure rise model is given by:

$$\text{if } ((\theta - EVO) \leq \pi) \text{ then} \quad (8)$$

$$P = \frac{(P_{exh} - P_{EVO})}{2}\left(1 + \cos\left((\theta - EVO)\frac{\pi}{\theta_{Dur}} + \pi\right)\right) + P_{EVO};$$

$$\text{else } P = P_{exh}$$

Figure 17:
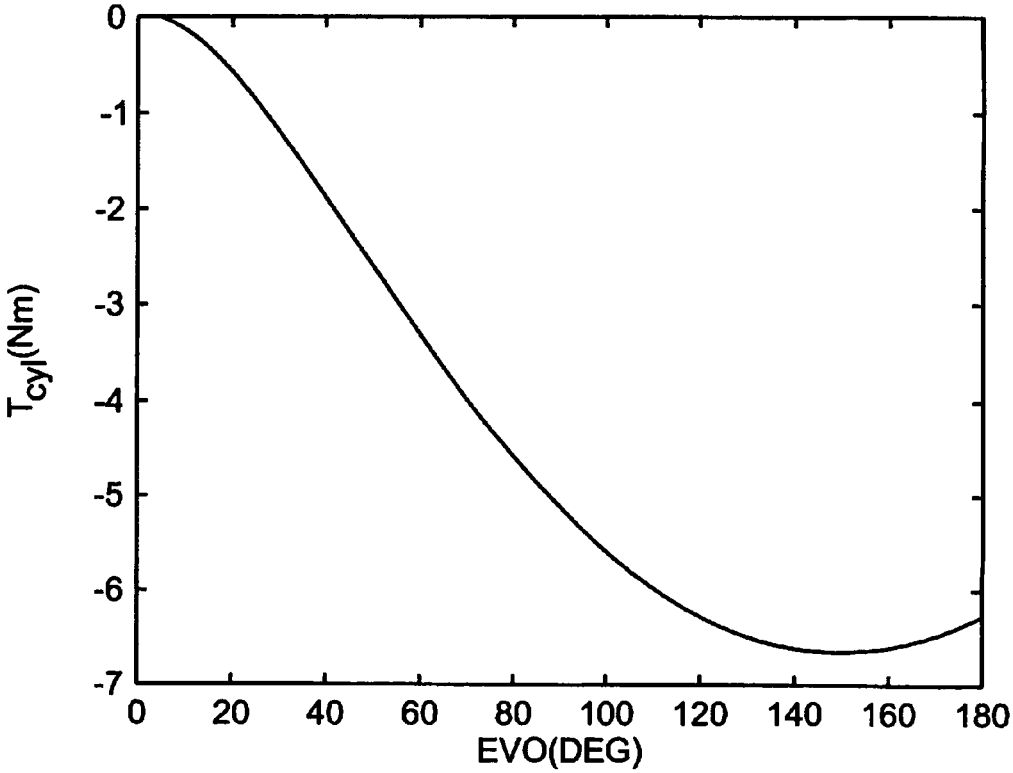
FIG. 17 shows Tcyl vs. EVO over a 360 Degree Cycle, w/Pressure Rise Adjustment and EVC=Zero.

The expansion $T_{cyl}$ vs. EVO curve in FIG. 17 was generated by adding a pressure rise model to the Tcyl vs. EVO calculation with a fixed $\theta_{Dur}$ of 60 degrees, resulting in a maximum average compression torque for 8 cylinders of −54 Nm at 150 degrees after TDC.

By using the average per cylinder compression and\or expansion torque given by Eqs. (3) through (6) and the pressure blow-off and rise models given by Eqs. (7) and (8), a map or regression of EVO as a function of Tcyl, EVC and engine operating conditions (see FIGS. 15 and 17) can be developed for use in the EVA engine control strategy. Note however that this is simply one approach that can be used, and other processes and/or approaches can be used. For example, maps can be generated based on engine mapping data for each set of conditions and then used with interpolation.

Figure 18:
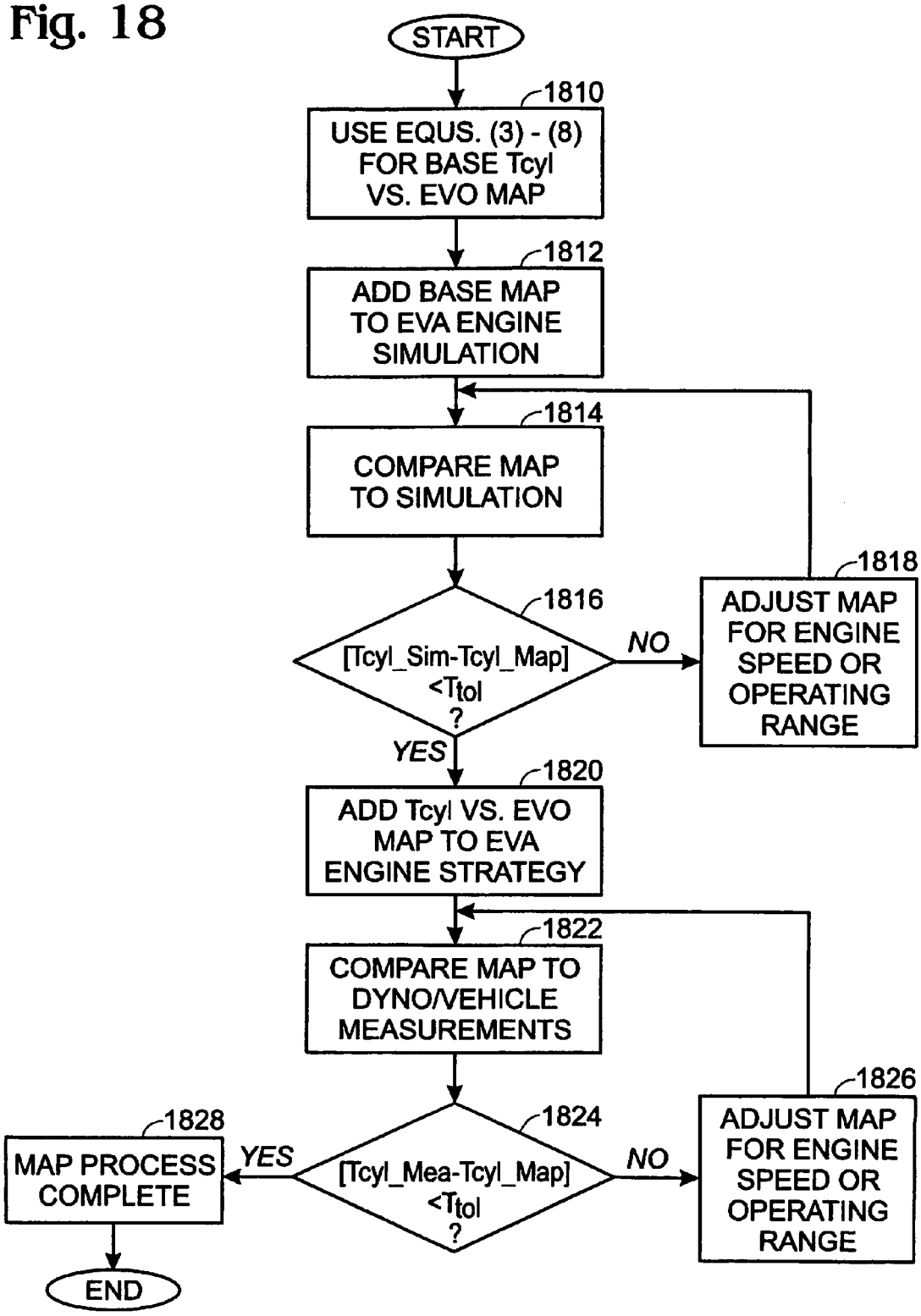
FIG. 18 shows an EVO vs. Compression and\or Expansion Tcyl Map Development Flow Chart.
Figure 19:
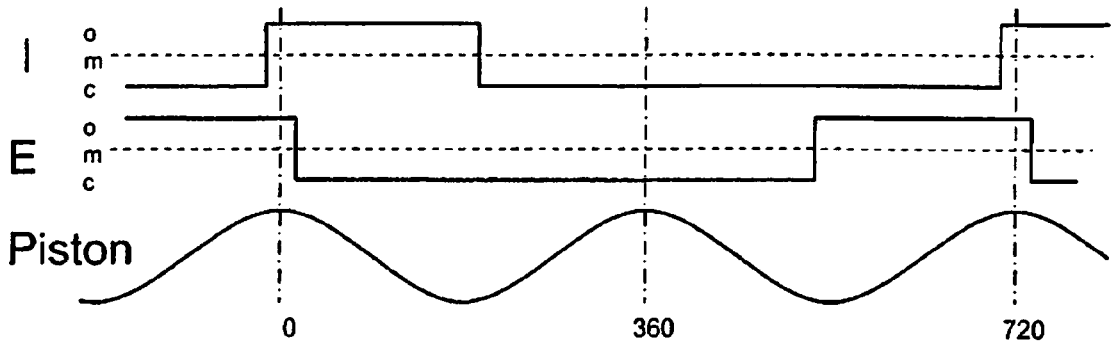
Fig. 19 Prior Art
FIGS. 19 and 20 show prior art valve timings.
Figure 20:
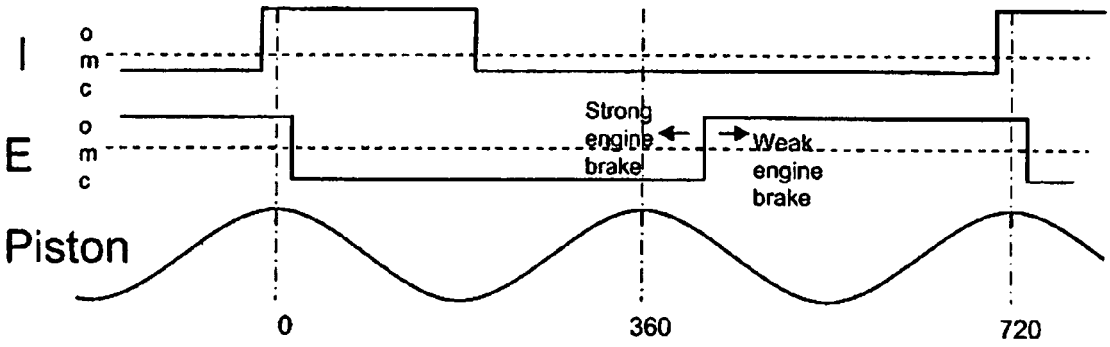
Fig. 20 Prior Art

In this example, by combining a mapping based upon Eqs. (3)–(8), as two or multi-dimensional tables and\or regressions, with adjustments to the base map as a function of engine speed or operating points, for example, maps of compression and\or expansion EVO vs. Tcyl can be developed for use in the EVA engine control strategy. An example process flow-chart for the development of compression and\or expansion EVO vs. Tcyl maps is shown in FIG. 18. Note also that while the above approach has illustrated to EVO timing can be used to control engine braking torque valves, this above approach can be applied to EVC, IVO, IVC, and combinations thereof.

Referring now to FIG. 18, a routine is described for generating an EVO vs. compression and\or expansion torque map. First, in step 1810, the routine uses equations (3) through (8) for a base torque versus exhaust valve opening 15, map. Then, in step 1812, the routine adds the base map to an engine simulation. Then, in step 1814, the routine compares the torque values in the map (Tcyl_map) to the simulation data (Tcyl_sim). If the comparison shows that the difference over a defined range of conditions is not less than a tolerance value (Ttol), then the map is adjusted for the specified speed or operating range in step 1818. Otherwise, the routine continues to step 1820 where the map is added to the engine strategy. Then, in step 1822, the routine compares the map to dynamometer and/or vehicle data. Again, a comparison is made to the tolerance value in step 1824; which may lead to further refinement of the map in step 1826, or to complete the process in step 1828. Note that this process can be carried out before vehicle production thereby resulting in an accurate map for use in production vehicles.

Referring now to FIGS. 21–24, an example traction control system that advantageously uses engine braking is described. In one embodiment, engine only traction control may be used (compared with transmission or anti-lock braking at the wheels) to control engine torque output so that wheel slip is controlled within a desired range thereby improving vehicle traction. This can be especially advantageous when combined with electronic valve actuation. In particular, if only an electronic throttle is used, there may be a large range of authority, but limited torque reduction speed due to manifold filling. Further, while ignition timing retard may be used to quickly control torque, the range of authority may be limited and may result in increased emissions and fuel economy loss, as also with enleanment. In other words, if spark retard is used, the increased unburned fuel and HC may negatively impact fuel economy and emissions. During operation, the available spark advance with respect to optimal torque timing may be close to zero, limiting the ability to increase engine brake torque.

Therefore, in a system with at least some electrically actuated engine valves, improved results may be obtained by combining torque production of firing and non-firing engine cylinders, in one embodiment. In other words, while a throttle may still be used to control torque, if desired, the maximum engine braking torque that can be generated with a throttle may be limited by the maximum vacuum that can be generated in the intake, e.g., less than 1 Bar. However, with electronic valve control (alone or in combination with a throttle) may generate higher levels of braking torque if required, as described above.

Therefore, in one embodiment, a controller first determines a number and the configuration of firing/non-firing cylinders, such as the various examples described above. Then, the controller determines a desired mode for the non-firing cylinders (e.g., expansion braking, compression braking, combinations of expansion/compression braking, intake side, exhaust side, or combinations thereof). Mode selection criteria may include available torque range, NVH, desired torque, vehicle and engine conditions, fuel economy, and/or combinations thereof.

Next, the controller sets valve timing on the firing cylinders (if any) to generate positive torque, and sets valve timing on the non-firing cylinders (if any) to generate negative torque.

Thus, the controller varies valve timing on the active cylinders to generate positive torque, varies valve timing on the inactive cylinders to generate negative torque (intake/exhaust expansion/compression braking), and may use torque control to determine the active/inactive cylinder valve timing that will produce the desired engine torque with the best fuel economy and NVH in response to a commanded torque request.

Figure 21:
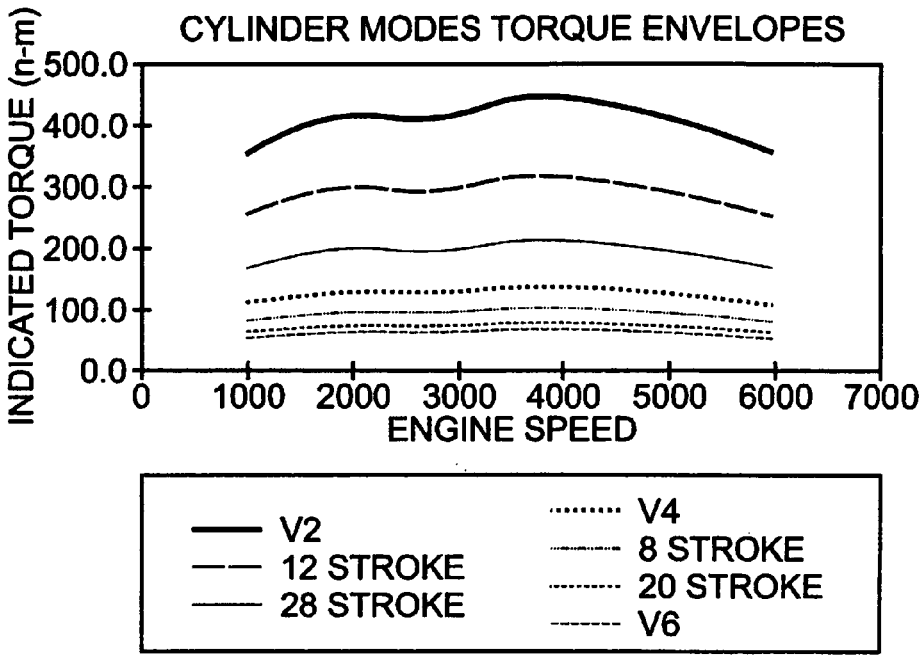
FIG. 21 shows potential positive indicated torque available from an 8 cylinder engine.
Figure 22:
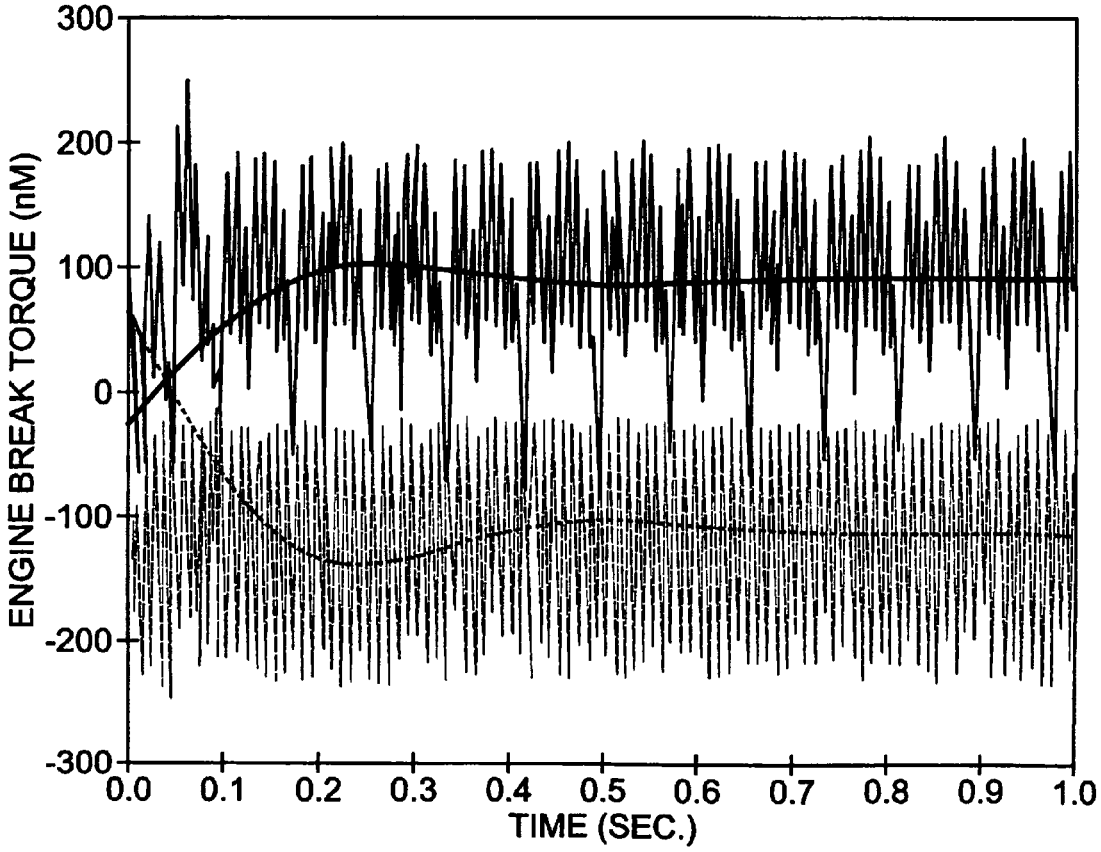
FIG. 22 shows engine brake torque vs. time with 1 (solid) and 8 (dashed) compression braking cylinders.

An example potential positive indicated torque available from a range of active cylinder modes, on an 8 cylinder engine, is illustrated in FIG. 21. Further, example engine brake torque vs. time responses is shown in FIG. 22. The solid line shows 4 active and 1 compression braking cylinder, where the additional 3 inactive cylinders have the intake valves closed and the exhaust valves open. The dashed line shows 8 compression braking cylinders.

Figure 23:
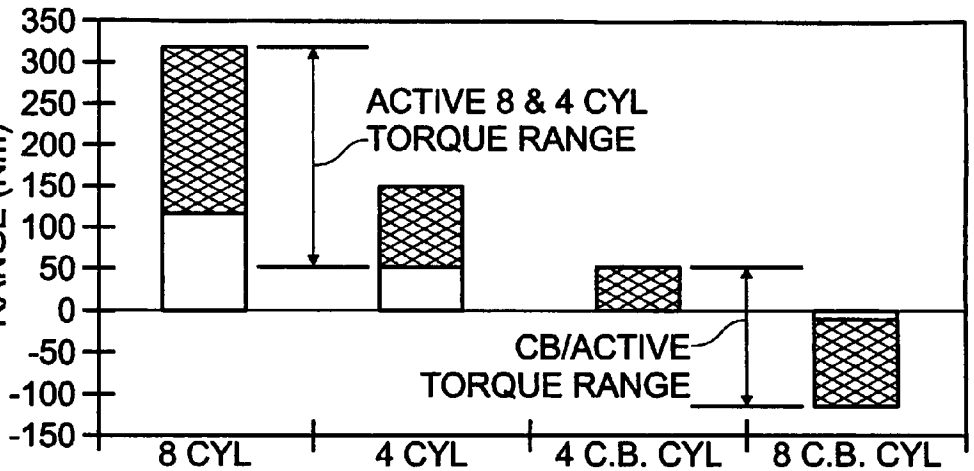
FIG. 23 shows a combined torque range for an 8 cylinder engine using 8 and 4 cylinder active modes and combined 4 active with 0 to 4 compression brake cylinders and 0 to 8 compression brake cylinders.

In FIG. 23, the brake torque range in 8 and 4 cylinder active modes, on an 8 cylinder engine, and combined active with between zero and 8 inactive cylinders in compression braking mode is shown. The brake torque range in this example is from a positive 300 Nm to a negative 100 Nm. As described above, the expansion braking mode can produce roughly half the brake torque per cylinder that can be generated in the compression mode, with a reduction in the peak-to-peak torque of roughly 80 percent. Therefore, if the expansion braking mode is used on the inactive cylinders, the total negative torque range is reduced by 50 percent, while potential NVH benefits of the reduced peak-to-peak torque may be achieved. Thus, such a mode may be used in cases where the negative torque required is within the expansion torque range.

Figure 24:
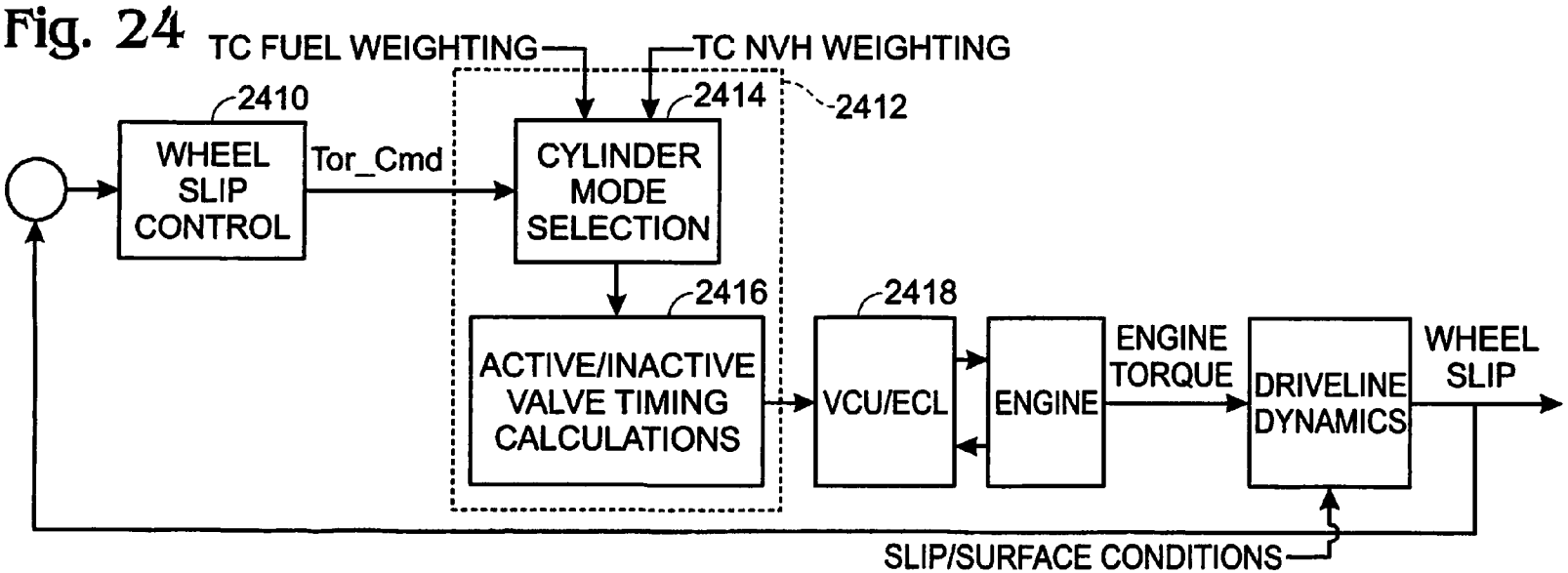
FIG. 24 shows a block diagram of an example traction control strategy.

Referring now to FIG. 24, an example traction control strategy is illustrated in block diagram from. As shown, the wheel slip control 2410 responds to the measured wheel slip to maintain the wheel slip within a desired range. Block 2410 generates a desired torque command (Tor_Cmd), which is transmitted to the torque structure 2412. Within the torque structure, the torque command is converted into a cylinder mode, e.g. 8, 4 active cylinders with compression and/or expansion braking (intake and/or compression) on inactive cylinders in block 2414 based in part on traction control fuel weighting (fuel economy) and noise and vibration weighting (NVH). Then the valve timings for the active and inactive cylinders are calculated and transmitted to the valve control and engine control units (VCU and ECU, respectively) in block 2416. In block 2418, the VCU/ECU control the valve, fuel and spark timing to produce the desired engine torque. The engine torque is transmitted by the engine to the driveline to drive the wheels, which based on surface conditions may produce wheel slip.

It will be appreciated that the configurations and routines disclosed herein are exemplary in nature, and that these specific embodiments are not to be considered in a limiting sense, because numerous variations are possible. For example, the above converter technology can be applied to V-6, I-4, I-6, V-12, opposed 4, and other engine types. Also, approach described above is not specifically limited to a dual coil valve actuator. Rather, it could be applied to other forms of actuators, including ones that have only a single coil per valve actuator, and/or other variable valve timing systems, such as, for example, cam phasing, cam profile switching, variable rocker ratio, etc.

The subject matter of the present disclosure includes all novel and nonobvious combinations and subcombinations of the various systems and configurations, and other features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

We claim:

1. A method for operating a cylinder with at least an intake and exhaust valve, the engine in a vehicle, the method comprising:

maintaining at least the exhaust valve in a closed position during a period of net engine torque less than zero, and during said period of net engine torque less than zero, operating with at least the intake valve open, then closing the intake valve, and then opening the intake valve.

2. The method of claim 1 where both said openings of the intake valve are within 720 crank angle degrees rotation of the engine.

3. The method of claim 1 where both said openings of the intake valve is within a single stroke of a piston in the cylinder.

4. The method of claim 1 wherein the engine further comprises an electronically controlled throttle plate that is adjusted based on an operating condition.

5. The method of claim 1 wherein the exhaust valve is mechanically actuated.

6. The method of claim 1 wherein said intake valve is an electromechanically actuated valve.

7. The method of claim 6 wherein one of intake valve opening and closing timing is varied to vary said amount of brake torque generated by the cylinder.

8. The method of claim 7 wherein a number of cylinders operated to vary said timing of said intake opening and closing is adjusted to vary an amount of brake torque generated by the engine.

9. The method of claim 1 wherein said openings include partially opening the intake valve.

10. The method of claim 1 wherein said period is one of a time period, an engine rotation degree period, and a variable period based on operating conditions or sensor feedback.

11. The method of claim 1 wherein gasses enter and exit the cylinder during said period on an intake side of the engine.

12. The method of claim 10 where fuel injection to said cylinder is deactivated at least during said period.

13. A method for operating a cylinder with at least an intake and exhaust valve and a piston, the engine in a vehicle, the method comprising:

maintaining at least the exhaust valve in a closed position during a period of a single stroke of the piston, and during said period of a single stroke of the piston, operating with at least the intake valve open, then closing the intake valve, and then opening the intake valve.

14. The method of claim 13 wherein said intake valve is an electromechanically actuated valve.

15. The method of claim 14 wherein one of intake valve opening and closing timing is varied to vary said amount of brake torque generated by the cylinder.

16. The method of claim 15 wherein a number of cylinders operated to vary said timing of said intake opening and closing is adjusted to vary an amount of brake torque generated by the engine.

17. The method of claim 16 wherein said openings include partially opening the intake valve.

18. A computer readable storage medium having instructions therein for controlling operation of cylinder with a piston, the cylinder having at least an intake and exhaust valve, the engine in a vehicle, the medium comprising:

instructions for maintaining at least the exhaust valve in a closed position during a period, and instructions for operating with at least the intake valve open, then closing the intake valve with the piston at a first position, and then opening the intake valve at a second position of the piston closer to bottom center than said first position, during said period.

19. The medium of claim 18 wherein said openings and closing are performed in a single stroke of the piston.

20. The medium of claim 18 wherein said openings and closing are performed over multiple strokes of the piston.

21. The medium of claim 18 wherein net engine torque is less than zero during at least a portion of said period.

22. The medium of claim 18 wherein the vehicle is decelerating at least a portion of said period.

23. The medium of claim 18 wherein the engine includes a plastic intake manifold.

24. A computer readable storage medium having instructions therein for controlling operation of cylinder with a piston, the cylinder having at least an intake and exhaust valve, the engine in a vehicle, the medium comprising:

instructions for maintaining at least the exhaust valve in a closed position during a period, and instructions for operating with at least the intake valve open, then closing the intake valve with the piston at a first position, and then opening the intake valve at a second position of the piston closer to top center than said first position, during said period.

* * * * *